US006345889B1

(12) United States Patent
Sakuraoka et al.

(10) Patent No.: US 6,345,889 B1
(45) Date of Patent: Feb. 12, 2002

(54) INK CARTRIDGE FOR INK JET PRINTER AND METHOD OF MAKING THE INK CARTRIDGE

(75) Inventors: Satoshi Sakuraoka, Mitaka; Shinichi Hisatomi, Tokorozawa; Katsuhiko Satoh, Hachioji, all of (JP)

(73) Assignee: Casio Computer Co., Ltd., Tokyo (JP)

( * ) Notice: Subject to any disclaimer, the term of this patent is extended or adjusted under 35 U.S.C. 154(b) by 0 days.

(21) Appl. No.: 09/357,267

(22) Filed: Jul. 20, 1999

(30) Foreign Application Priority Data

Jul. 30, 1998 (JP) ..... 10-214942

(51) Int. Cl.[7] ..... B41J 2/175
(52) U.S. Cl. ..... 347/86
(58) Field of Search ..... 347/85, 86, 87

(56) References Cited

U.S. PATENT DOCUMENTS

| | | | | |
|---|---|---|---|---|
| 5,113,199 A | * | 5/1992 | Chan et al. | 347/87 |
| 5,283,593 A | | 2/1994 | Wehl | 347/81 |
| 5,576,750 A | | 11/1996 | Brandon et al. | 347/87 |
| 5,971,530 A | * | 10/1999 | Hashimoto | 347/86 |

FOREIGN PATENT DOCUMENTS

| | | | |
|---|---|---|---|
| EP | 0 373 302 A1 | | 9/1990 |
| EP | 0 579 492 A1 | | 1/1994 |
| EP | 0 586 079 A1 | | 3/1994 |
| EP | 0 709 211 A1 | | 5/1996 |
| EP | 0 802 056 A2 | | 10/1997 |
| EP | 947 328 | * | 10/1999 |
| GB | 2 293 141 A | | 3/1996 |

* cited by examiner

*Primary Examiner*—N. Le
*Assistant Examiner*—Michael P. Nghiem
(74) *Attorney, Agent, or Firm*—Frishauf, Holtz, Goodman, Langer & Chick, P.C.

(57) ABSTRACT

By forming an outer wall over a space around an ink storage chamber of an ink cartridge or by providing convexities arranged at intervals of not more than 10 mm on an outer surface of a housing which forms the ink storage chamber, a possible ink recharging hole provided in the housing is prevented from being sealed. Different kinds of ink cartridges are manufactured which have different inner compositions which cannot be discriminated in appearance. Any desired ink cartridges are selected randomly from those manufactured ones and shipped. This prevents the user from recharging any one of the ink cartridges with an ink from an unreliable source through a possible hole formed in the wall of the ink cartridge to thereby prevent a print head and/or printer from malfunctioning.

5 Claims, 16 Drawing Sheets

INK CARTRIDGE FOR INK JET PRINTER AND METHOD OF MAKING THE INK CARTRIDGE

BACKGROUND OF THE INVENTION

The present invention relates to ink cartridges for ink jet printers for preventing the ink cartridges from being recharged with inks, and methods of making the ink cartridges.

Recently, thermal ink jet type printers have prevailed. The thermal ink jet type printer includes a print head which, in turn, includes a plurality of heating elements arranged in the form of an array on a substrate. The plurality of heating elements of the print head are selectively heated in accordance with printing information to heat an ink supplied onto the heating elements. Thus, a film boiling phenomenon in which bubbles are produced instantaneously on the interface between the ink and the heating elements is used to jet ink drops out of fine ink jet ports arranged in correspondence to the respective heating elements to thereby print information on recording paper. In order to compensate for the ink consumed in printing, an ink is appropriately supplied from an ink cartridge in which the ink is stored to the print head as requested.

Generally, there are two types of ink cartridges: one is of the type separate from the print head and the other is of the type integral with the print head. FIG. 1A is a schematic side view of an ink cartridge integral with the print head of an ink jet printer such as is mentioned above. FIG. 1B is a bottom view (or a head front view) of the cartridge of FIG. 1A. As shown in FIGS. 1A and lB, in this ink cartridge, the print head is unseparably integral with an ink tank 2 through an ink feeding section 3. The print head 1 is for color printing. To this end, the ink tank 2 has three ink chambers 4 (4*a*, 4*b*, 4*c*) in which three subtractive primary colors; that is, magenta, cyan, and yellow inks are filled.

The print head 1 has on its front substrate 5 three lines of nozzles 6 (6*a*, 6*b*, 6*c*) which respectively jet ink drops of the three subtractive primary colors. Such print head is generally made, using a silicon LSI technique and a thin film technique. More specifically, a plurality of heating elements (not shown) are provided in the form of an array on the silicon tip substrate 5. A partition which forms ink paths is disposed on the substrate, and further, an orifice plate is then layered to form the lines of nozzles 6, which jet inks, at positions on the orifice plate corresponding to the heating elements. The nozzles are supplied with inks through the ink feeding section 3 from the respective ink chambers 4 of the ink tank 2 corresponding to the lines of nozzles 6.

FIG. 2 is a decomposed perspective view of the ink cartridge 2. An ink tank itself 2*a* has an inside which is partitioned into three ink chambers 4*a*, 4*b*, 4*c* of substantially the same size arranged side by side with at least two surfaces of the ink chambers sharing an outer wall of the ink tank 2*a* itself.

The ink feeding section 3 positioned below the ink chambers 4 has three ink feeding holes 7 provided in correspondence to the respective ink chambers 4. The ink within the ink chambers 4*a*, 4*b*, and 4*c* are fed through the ink feeding holes 7 to the lines of nozzles 6 (FIG. 1B) in the print head 1 through ink paths (not shown).

Ink absorbents (not shown) are provided within the ink chambers 4*a*, 4*b* and 4*c* so as to prevent the inks from flowing uselessly to the outside due to gravity. An inner lid 2*b* is fixed to the top of the ink chambers 4*a*, 4*b* and 4*c* , for example, by thermal fusing or bonding. Three conductive holes 8 are formed in the lid 2*b* at positions corresponding to the respective ink chambers 4*a*, 4*b* and 4*c* such that inks are injected or filled into the ink absorbents within the corresponding ink chambers through the respective conductive holes 8.

After the inks are filled, a box-like space former 2*c* is thermally fused or bonded to the top of the lid 2*b*. The space former 2*c* has a small vent 11*a* on its top to form an air chamber 9 between the space former 2*c* and the lid 2*b*. The respective ink chambers 4*a*, 4*b* and 4*c* communicate with the air through air paths extending from the air vent 11*a* through the air chamber 9 to the respective holes 8. By this air ventilation, the ink chambers 4*a*, 4*b* and 4*c* are released from their sealed state such that the inks stored within the ink chambers 4*a*, 4*b* and 4*c* smoothly flow out to the print head 1.

When the inks are consumed and no sufficient quantities of inks remain in the ink chambers of the ink cartridge, the ink cartridge is removed along with the print head from the printer since the cartridge is integral with the print head, and a new ink cartridge integral with a new print head is instead set in the printer for use. If the cartridge is not integral with the print head, only the ink cartridge is removed and replaced with a new one. Anyway, the cartridge has a structure in which recharging the ink cartridge with inks is not considered.

Some users of the printer may try to recharge with inks its ink cartridge whose ink recharging is not ordinarily considered. To this end, the user drills a hole in position in a surface of each chambers 4*a*, 4*b* and 4*c* common to an outer surface of the cartridge 2*a* to achieve fluid communication between that ink chamber and the outside, recharges a different ink of the same color as the ink stored in that chamber, from the outside through the hole into the chamber, and seals the hole with sealing paper, a film having an adhesive thereon or an elastic material such as rubber.

The ink recharged into the chamber will mix with the previous ink remaining in the ink absorbent. The recharged ink may have been made in a manner different from that in which the remaining ink was made and hence may be different in quality from the latter ink. If the recharged ink is of a low quality, the mixed ink may have a low quality. Especially, in the full color printing which reproduces colors of an original image by superposing fine colors, no satisfactory image would be printed often.

In addition, when an deterioration in the ink quality influences not only the ink hue, but also its composition, the nozzles could be sealed to thereby cause the printer to malfunction. In addition, when a low quality ink is used for recharging, it might seal the nozzles themselves before the resulting ink has a deteriorated quality due to mixture of the low quality ink and the previous remaining ink. If the recharged ink quality is ill-suited to the ink absorbent, the ink can leak and/or insufficient supply of the ink would occur. When the recharging hole is provided in the cartridge, the strength of the cartridge itself would decrease and the ink might leak due to insufficient sealing of the hole.

BRIEF SUMMARY OF THE INVENTION

It is an object of the present invention to provide an ink cartridge into which no ink can be substantially recharged.

The above object is achieved by an ink cartridge which stores an ink fed to a print head which jets the ink depending on printing data, comprising:

a housing having an ink feeding section for feeding to the print head the ink stored in the ink cartridge;

at least one inner chamber included in the housing, fluid communicating with the air, and filled with an ink; and an outer chamber provided between the at least one inner chamber and the housing, excluding the ink feeding section.

According to the ink cartridge, even when a recharging hole is formed in the inner chamber, the hole cannot be sealed. Thus, when the ink recharged into the inner chamber would leak to the outer chamber or when the outer chambers are being filled with other color inks, those different color inks would mix, such that satisfactory printing cannot be performed, using such cartridge.

In the ink cartridge, preferably, the outer chamber fluid communicates with the air and filled with an ink whose color is different from that of the ink stored in the inner chamber.

The outer chamber may be partitioned into a plurality of subchambers, one of which is an air chamber which places the inner chamber and the air in fluid communicating relationship. Preferably, the ink cartridge is integral with the print head.

According to the present invention, the above object is achieved by a second ink cartridge which stores an ink to be fed to a print head which jets the ink depending on printing data, comprising:

an ink storage chamber having an ink feeding section for feeding the stored ink to the print head; and anti-sealing means, provided on at least a part of an outer surface of the ink storage chamber excluding the ink feeding section, for preventing a possible hole provided in the outer surface of the ink storage chamber from being sealed.

In the second ink cartridge of the present invention, it is difficult to form an appropriate recharging hole in the wall of the ink tank, and it is also very difficult to seal the hole completely. Thus, even when an ink is recharged, the ink would leak out from the hole to thereby soil the inside of the printer undesirably. Thus, recharging of an ink into the ink cartridge by the user can be substantially prevented.

In the second ink cartridge, the anti-sealing means is preferably provided on substantially the entire outer surface of the ink storage chamber excluding the ink feeding section. The anti-sealing means comprises a plurality of spaced convexities whose height is not less than 0.1 mm, preferably 1 mm, and the interval between any adjacent convexities is not more than 10 mm, preferably 5 mm. Preferably, the plurality of convexities each take the form of a ridge or a dot-like protrusion.

The anti-sealing means may comprise an outer wall provided through a space over an outer surface of the ink storage chamber, excluding the ink feeding section.

the ink storage chamber may comprise therein an inner chamber and an outer chamber surrounding the inner chamber. The ink cartridge is preferably integral with the print head.

Another object of the present invention is to provide an ink cartridge making method which can substantially prevent recharging of an ink even when no special anti-sealing means, as mentioned above, is provided.

The above object is achieved by a method of making a plurality of ink cartridges for use in an ink jet printer which has a print head which, in turn, has a plurality of lines of nozzles which discharges inks depending on data to thereby record the data, comprising the steps of:

making, using a single sort of mold or a plurality of sorts of molds, a plurality of sorts of ink cartridges which each include at least a plurality of ink feeding ports which fluid communicate through a plurality of ink paths with the plurality of lines of nozzles, and a plurality of ink chambers which fluid communicate with the plurality of lines of nozzles via the plurality of ink feeding ports, wherein the plurality of sorts of ink cartridges have the same appearance, and different arrangements of the plurality of ink chambers or different combinations of the plurality of lines of nozzles and the ink chambers which are placed in fluid communicating relationship through the plurality of ink feeding ports;

selecting inks of respective colors such that the respective colors of the selected inks fed to the plurality of lines of nozzles are fixed; and filling the respective ink chambers of each of the plurality of cartridges with the corresponding selected inks.

According to the cartridge making method, a plurality of sorts of ink cartridges are made having inner ink chambers of different compositions but having the same appearance which anybody can not discriminate one from the other. Thus, even when the user tries to recharge an ink into this ink cartridge, he or she cannot recognize from the appearance of the cartridge where in the cartridge what colors of inks are filled. Thus, the user cannot recharge required inks into the cartridge. Thus, only by shipping ink cartridges of different sorts as parts randomly without providing any special anti-sealing means in the cartridges, recharging of inks into the ink cartridge by the user can be substantially prevented.

In this ink cartridge making method, each the ink cartridge preferably is integral with the print head. Preferably, the plurality of ink chambers of each of the ink cartridges are arranged so as to cross all the plurality of lines of nozzles of the print head, and that the plurality of sorts of ink cartridges have different combinations of plurality of lines of nozzles and ink chambers which are placed in fluid communicating relationship through the respective ink feeding ports.

In the cartridge making method, each of the ink cartridge may have a fluid interface member integral therewith having a plurality of ink paths which place the plurality of lines of nozzles and the corresponding plurality of ink feeding ports in fluid communicating relationship. According to this method, the print heads can be made so as to have the same structure, such that they can be made easily to thereby reduce the manufacturing cost.

BRIEF DESCRIPTION THE SEVERAL VIEWS OF THE DRAWING

Figure 5:
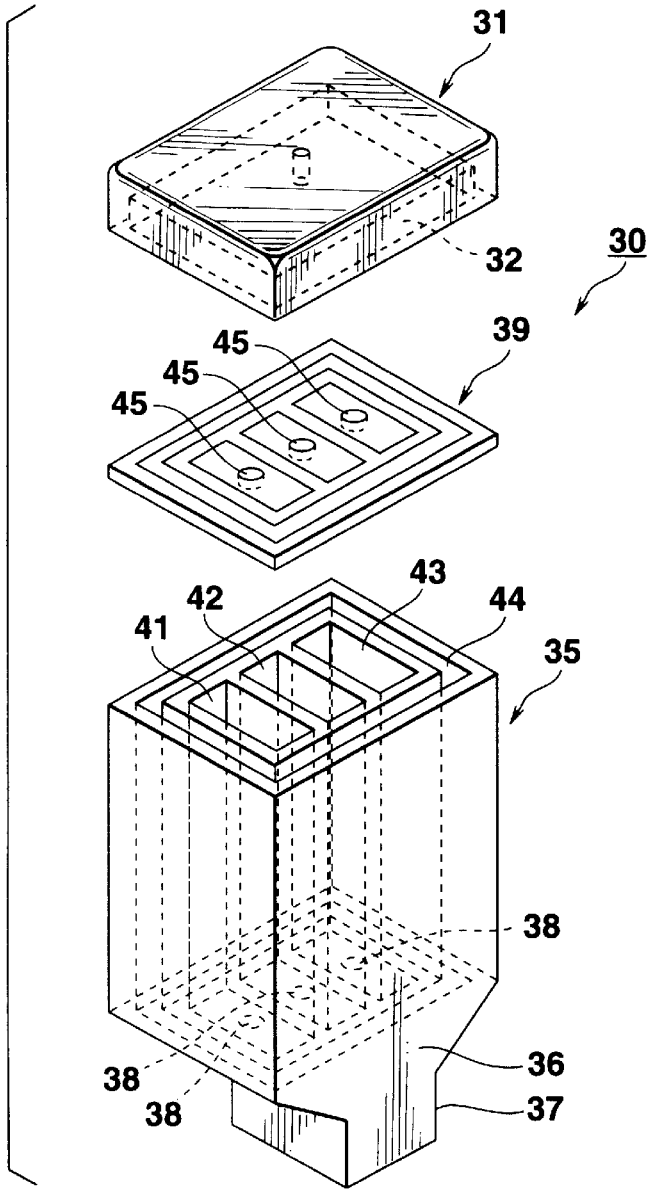
Figure 6:
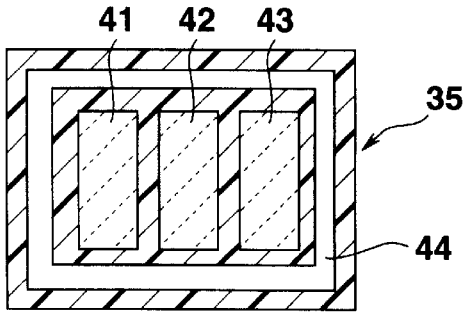
Figure 7:
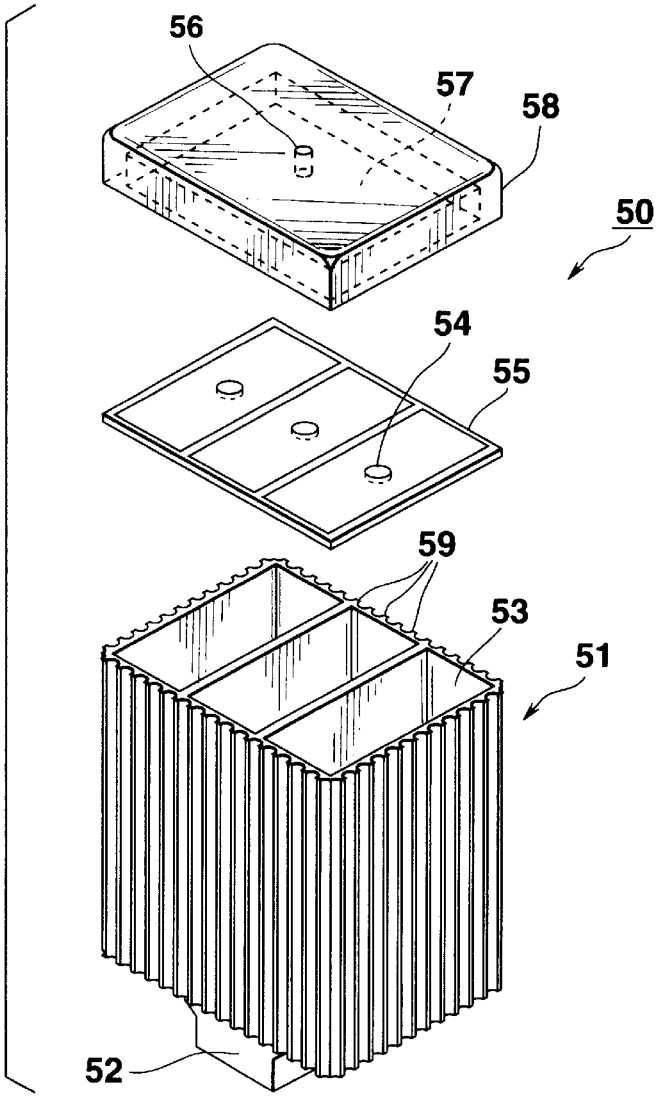
Figure 8:
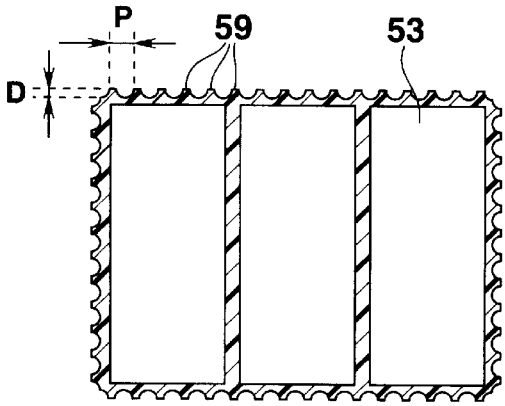
Figure 9:
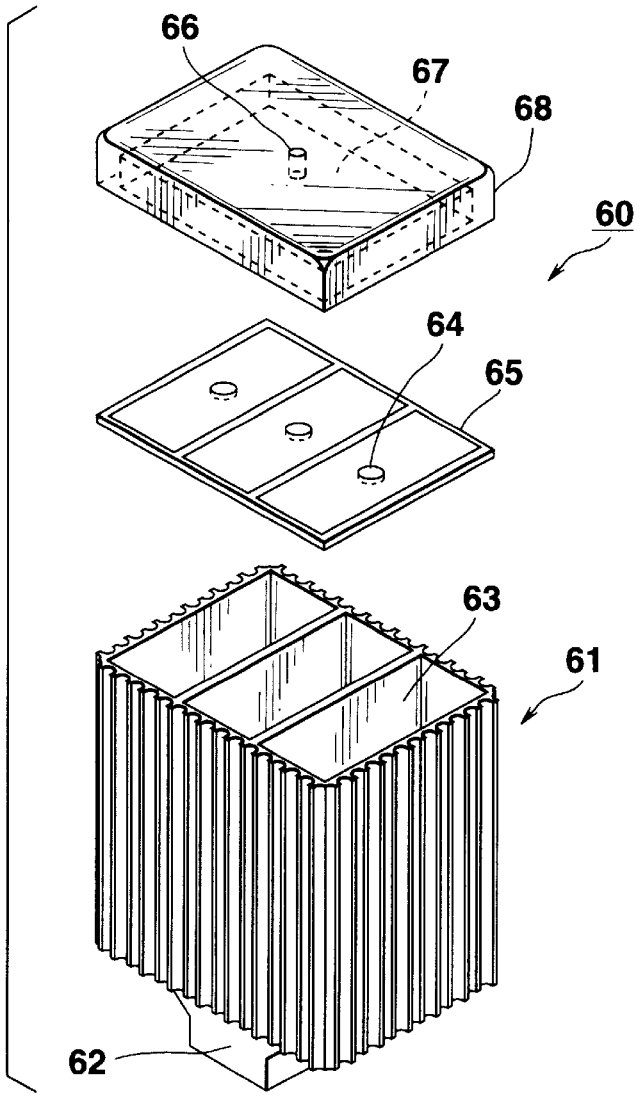
Figure 10:
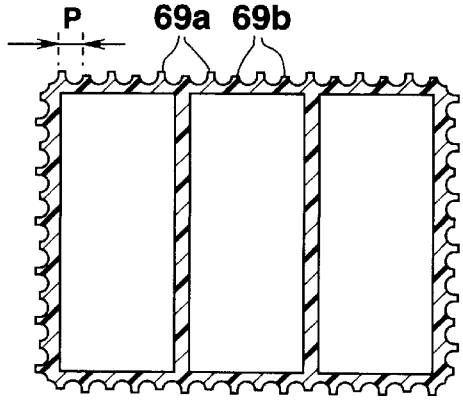
Figure 11:
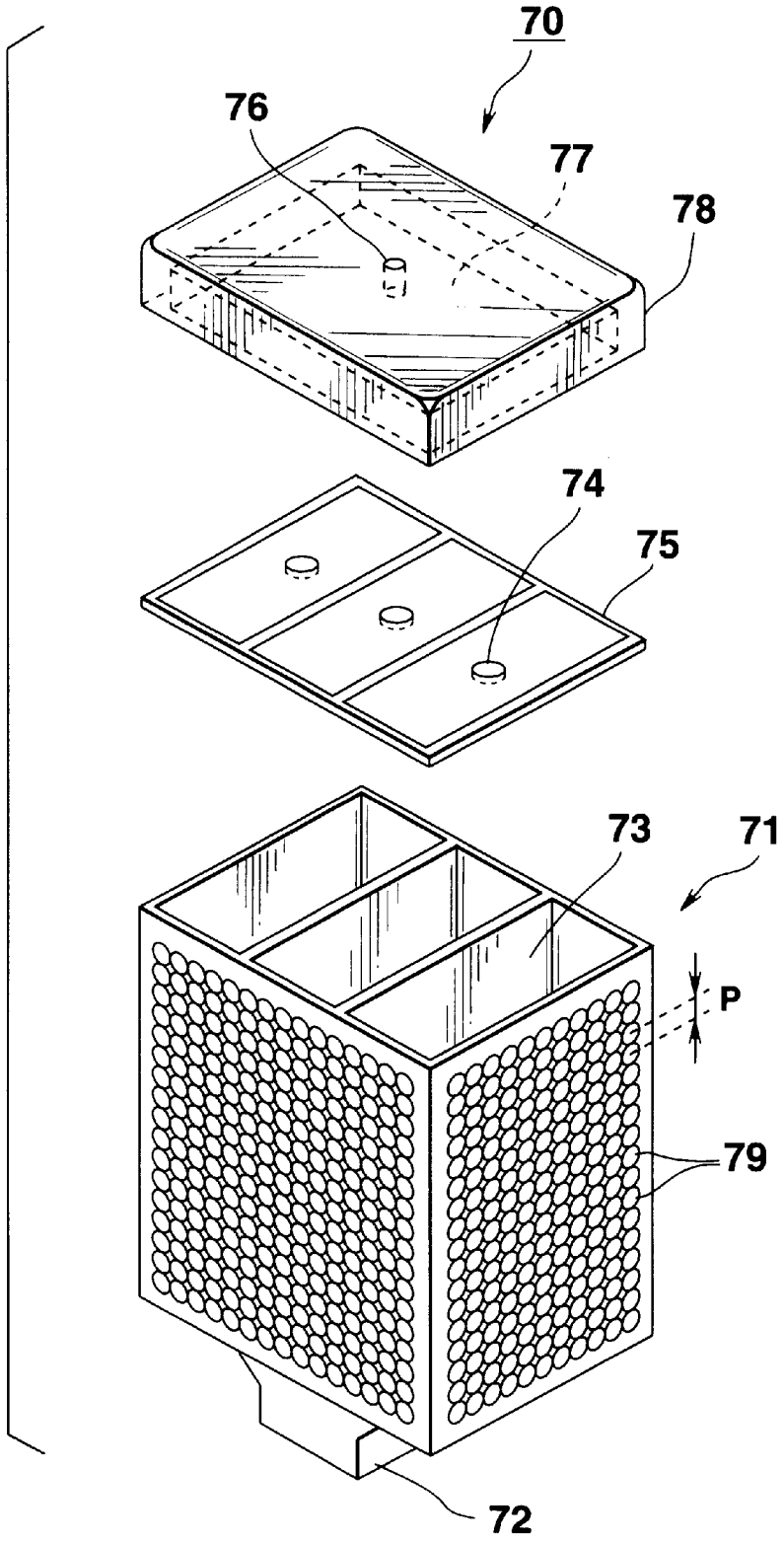
Figure 13A:
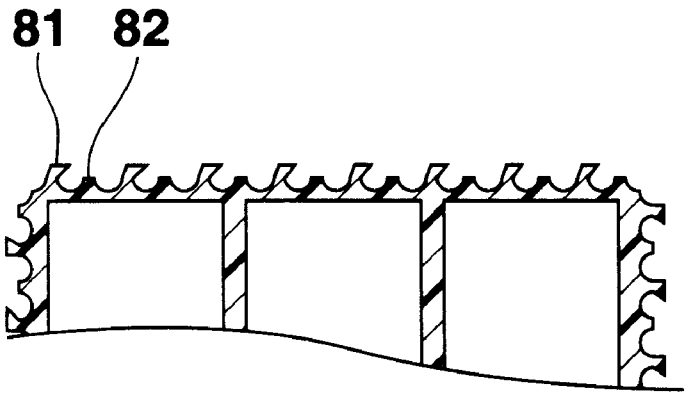
Figure 13B:
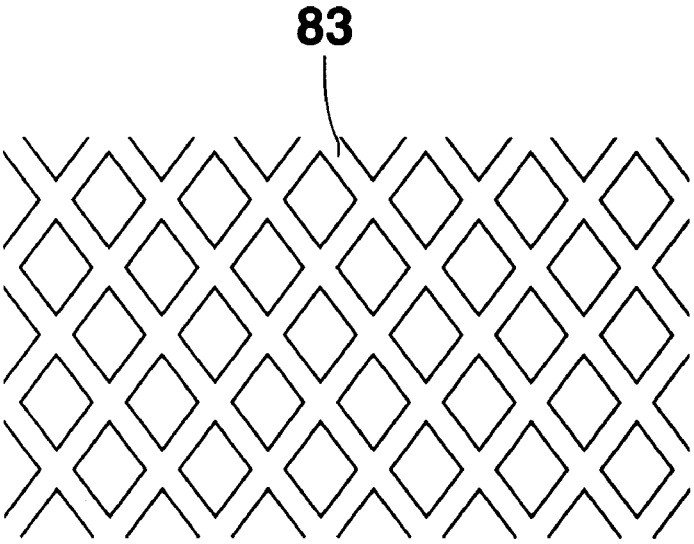
Figure 14:
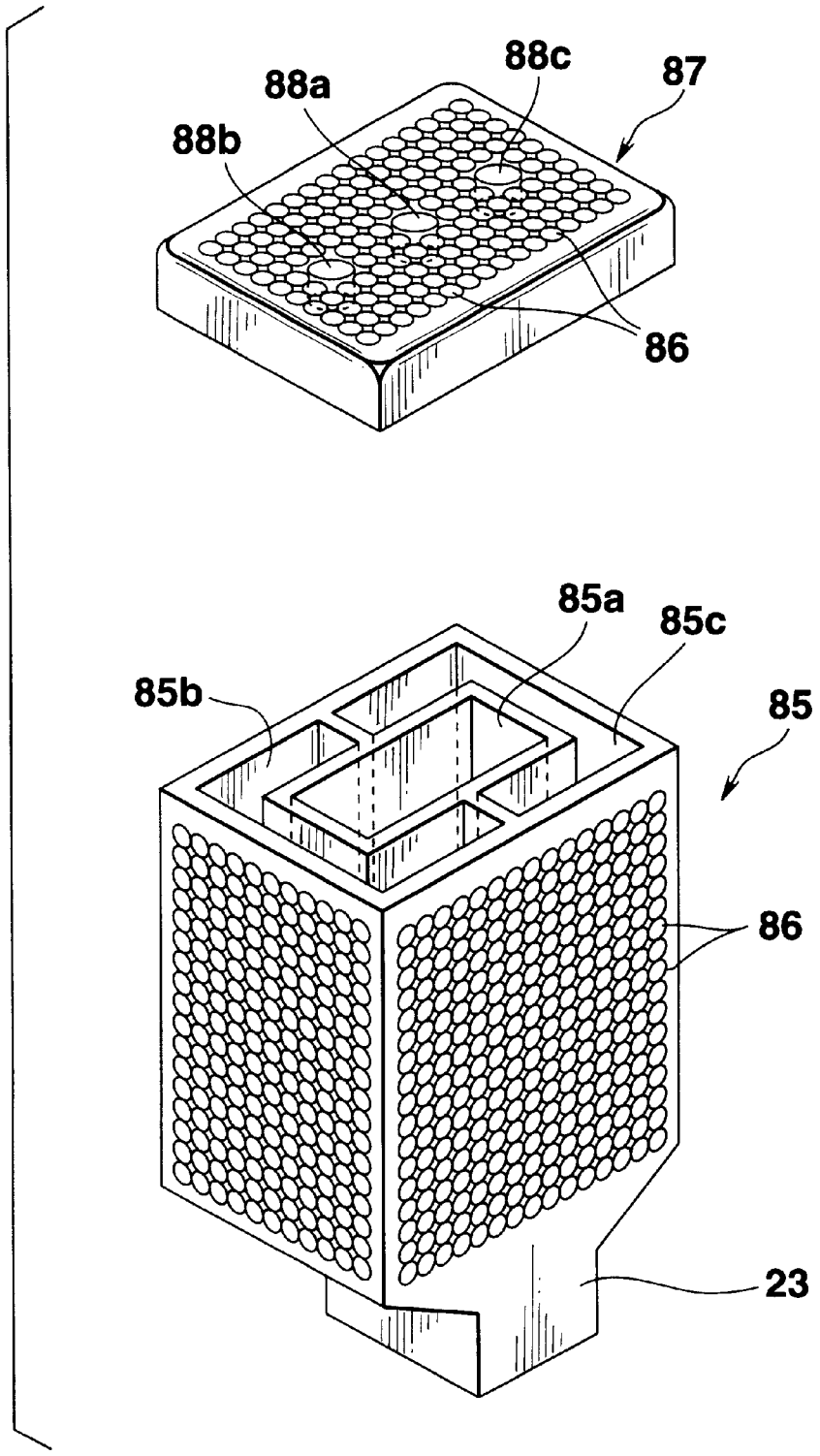
Figure 15:
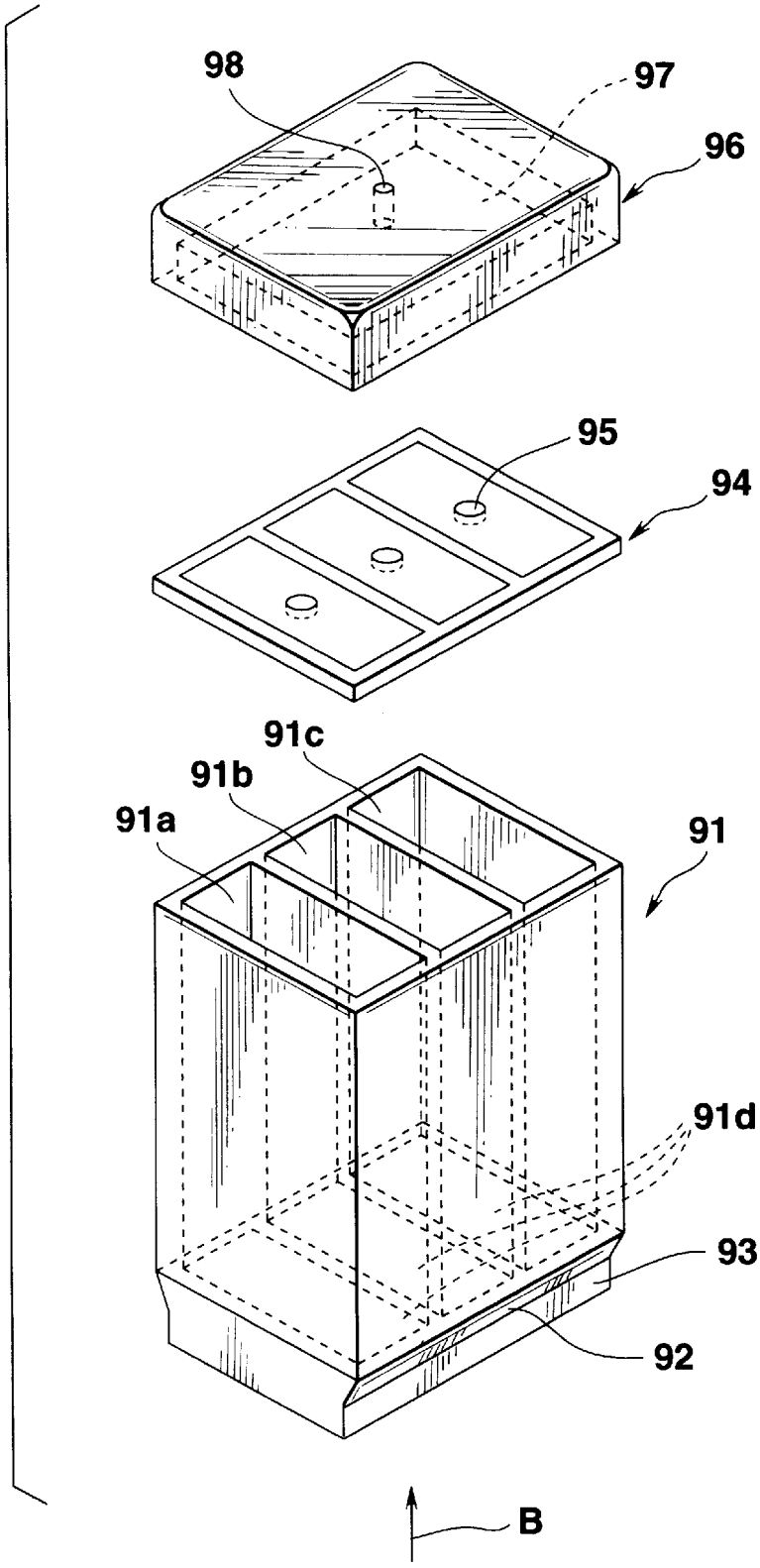
Figure 16A:
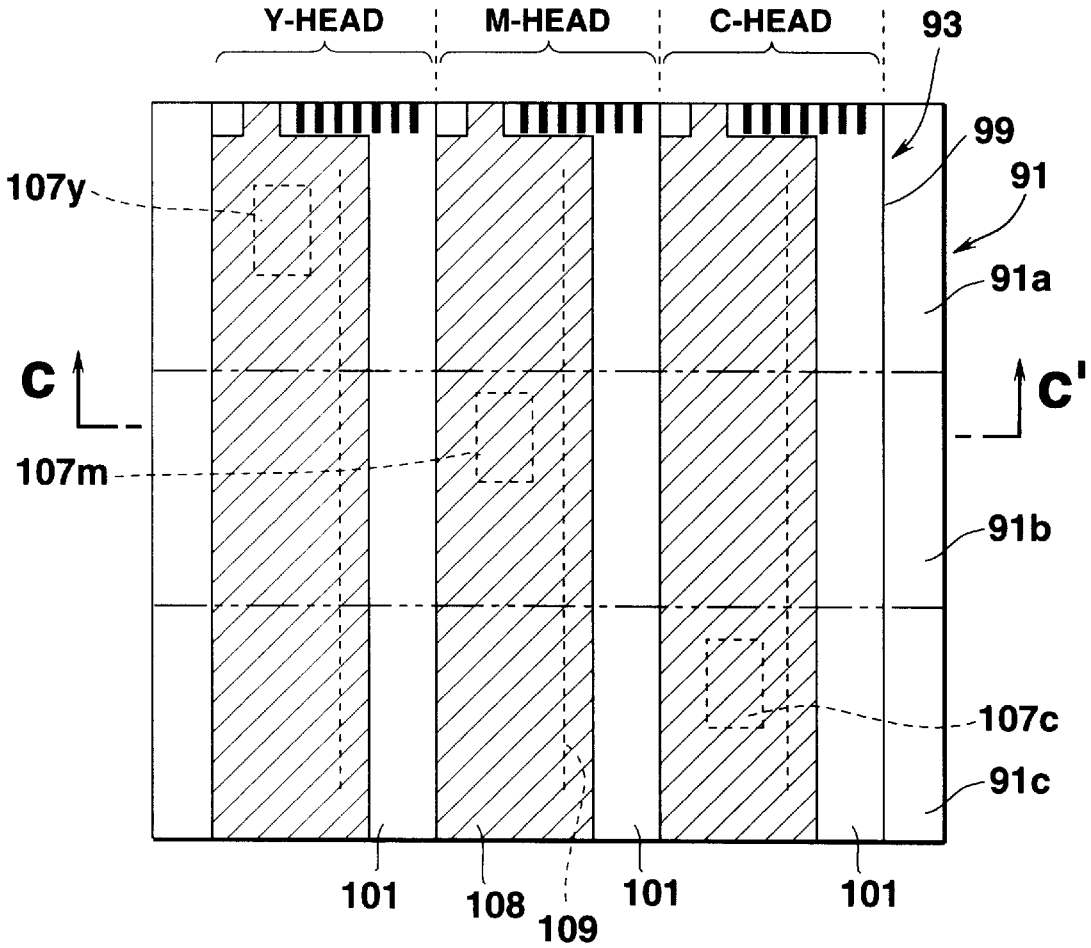
Figure 16B:
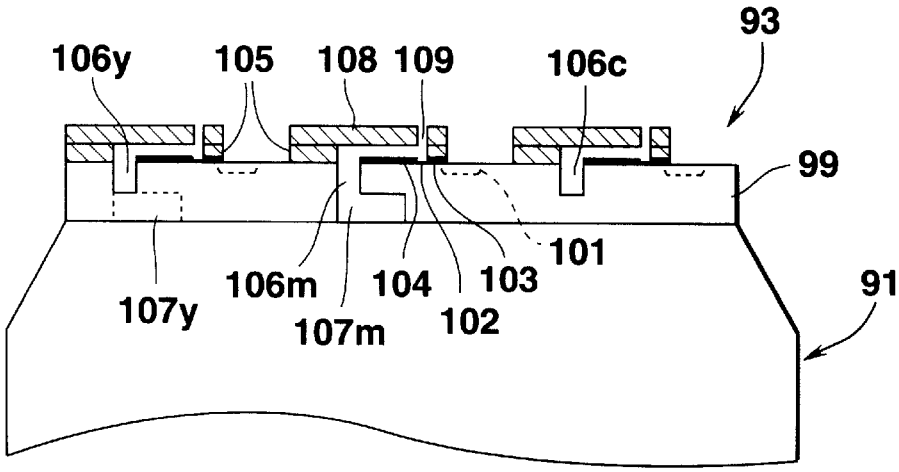
Figure 18B:
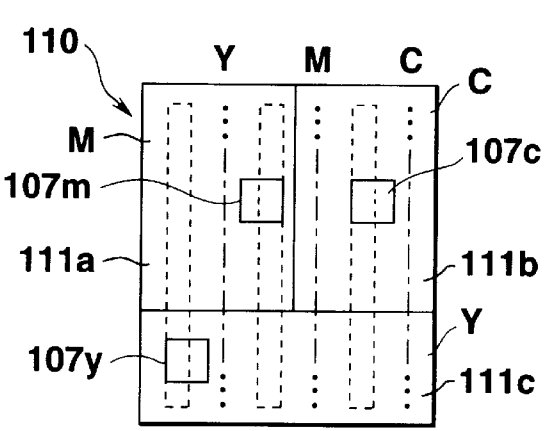
Figure 18A:
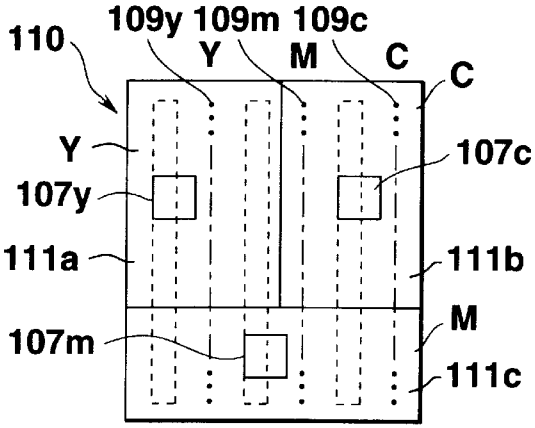
Figure 19C:
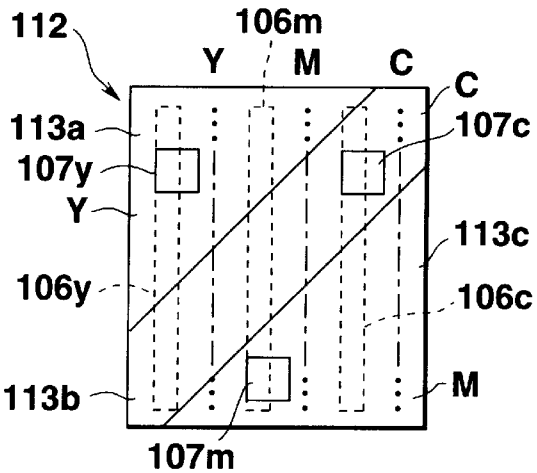
Figure 19B:
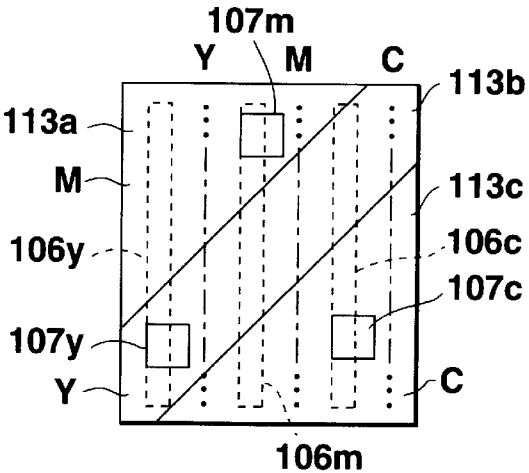
Figure 19A:
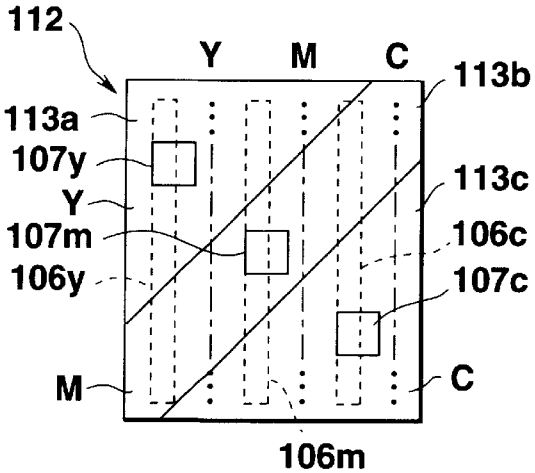
Figure 20A:
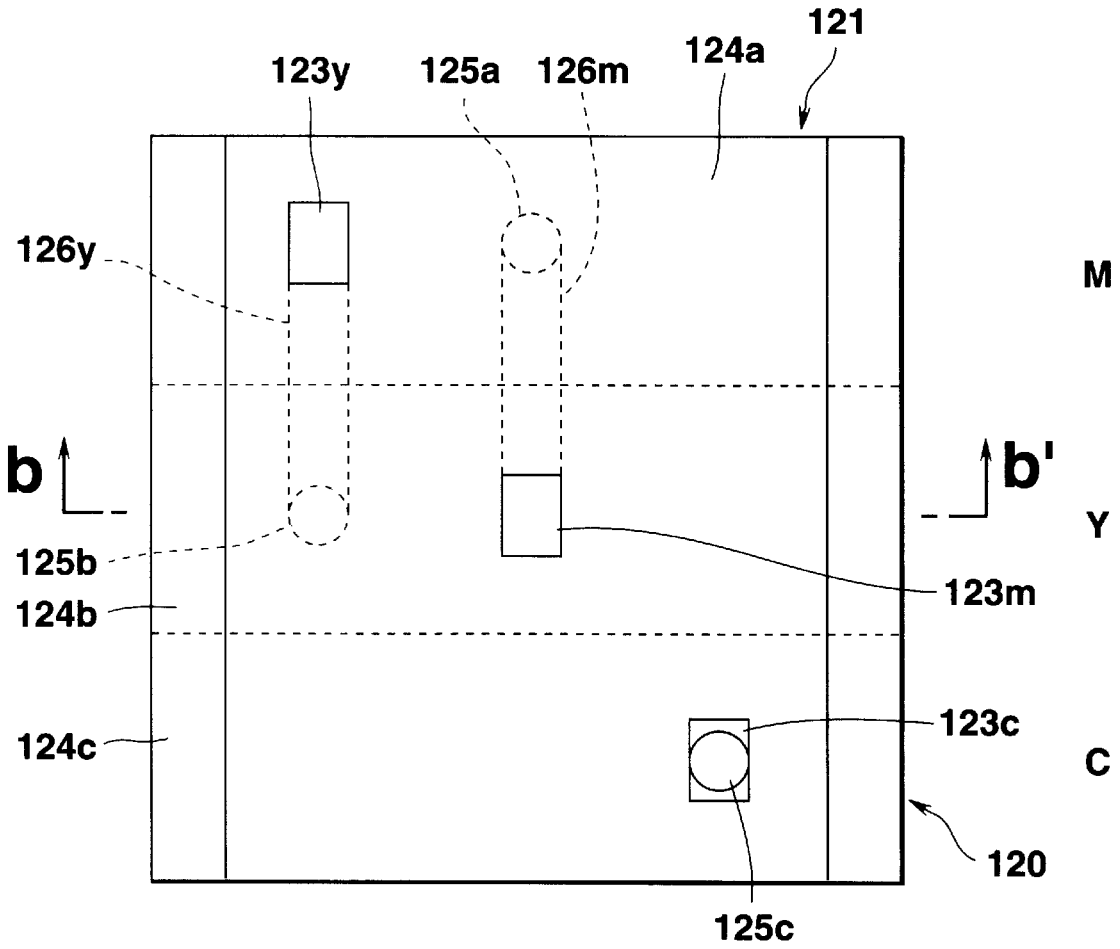
Figure 20B:
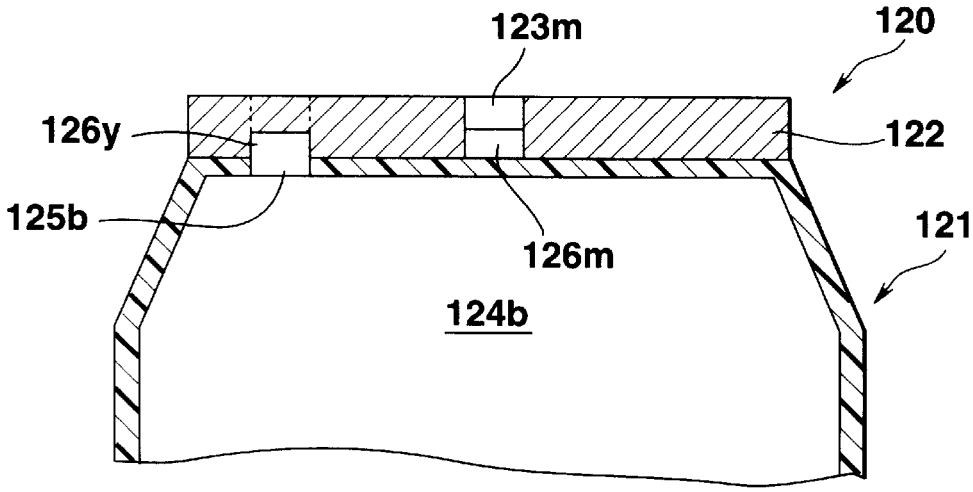

FIG. 5. is a decomposed perspective view of an integrated print. head-ink cartridge unit of a second modification of the first embodiment;

FIG. 6 is a plan cross-sectional view of an ink tank of the second modification;

FIG. 7 is a decomposed perspective view of an integrated print head-ink cartridge unit of a second embodiment of the present invention;

FIG. 8 is a plan cross-sectional view of an ink tank of the second embodiment;

FIG. 9 is a decomposed perspective view of an integrated print head-ink cartridge unit of a modification of the second embodiment;

FIG. 10 is a plan cross-sectional view of an ink tank of a modification of the second embodiment;

FIG. 11 is decomposed perspective view of an integrated print head-ink cartridge unit of a third embodiment of the present invention;

FIGS. 12A to 12G each illustrates a modification of the form a corrugation as the anti-sealing means in the present invention;

FIG. 13A is a plan cross-sectional view of an ink tank with a further modification of the corrugation or convexities as the anti-sealing means;

FIG. 13B illustrates a still further modification of the convexities as the anti-sealing means;

FIG. 14 is a decomposed perspective view of an integrated print head-ink cartridge unit of a fourth embodiment of the,present invention;

FIG. 15 is a decomposed perspective view of an integrated print head-ink cartridge unit of a fifth embodiment of the present invention;

FIG. 16A is a plan view of the ink cartridge unit of the fifth embodiment viewed in the direction of an arrow B;

FIG. 16B is a cross-sectional view taken along a line C–C' of FIG. 16A;

FIGS. 17A to 17F each schematically illustrate a different combination of ink feeding holes and ink chambers of the fifth embodiment;

FIGS. 18A, and 18B each schematically illustrate a modification of the fifth embodiment;

FIGS. 19A, 19B and 19C each schematically illustrates a further modification of the fifth embodiment;

FIG. 20A is a plan view of an ink cartridge separate from a print head as a still further modification of the fifth embodiment; and FIG. 20B is a cross-sectional view taken along a line b–b' of FIG. 20A.

DETAILED DESCRIPTION OF THE INVENTION

Preferred embodiments of the present invention will be described next with reference to the accompanying drawings.

Figure 3:
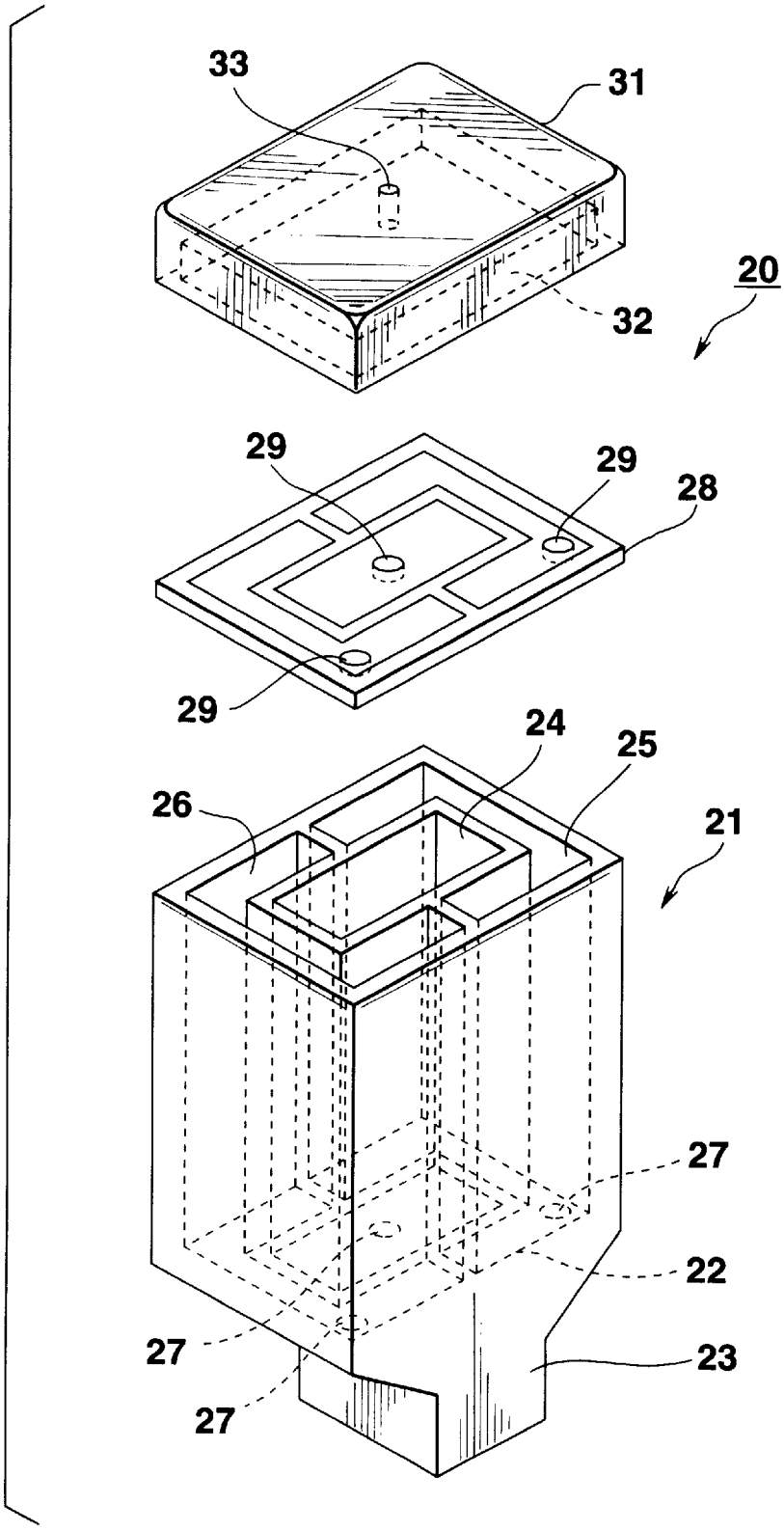
FIG. 3 is a decomposed perspective view of an integrated print head-ink cartridge unit as a first embodiment of the present invention.

FIG. 3 is a decomposed perspective view of an integrated print head-ink cartridge unit as a first embodiment of the present invention. As shown in FIG. 3, the cartridge unit 20 includes an ink tank 21 and an print head 23 integral unseparably with the ink tank 21 disposed below the ink tank 21. The print head 23 has three lines of nozzles (not shown) which are similar in arrangement to those of the print head 1 of FIG. 1B.

Figure 1A:
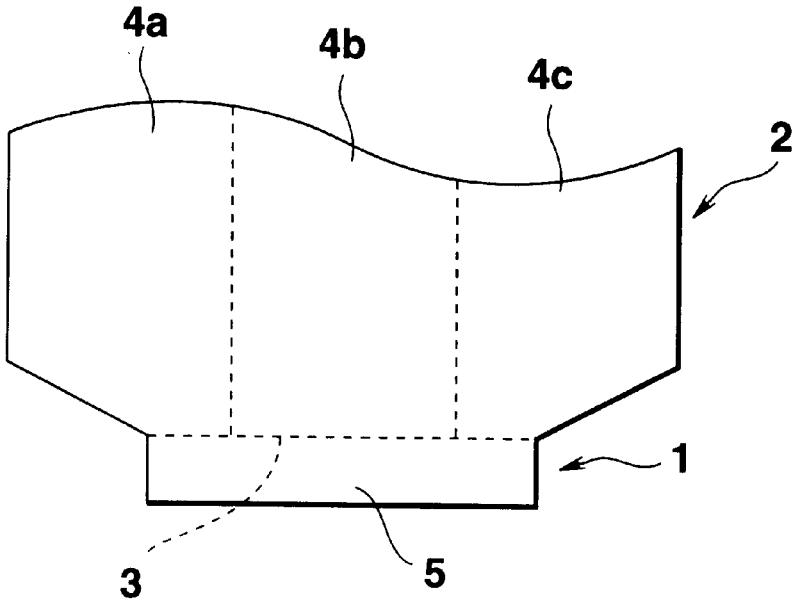
FIG.1A (PRIOR ART)
FIGS. 1A and 1B are, respectively, a partial elevation of a conventional integrated print head-ink cartridge unit and a bottom view of the print head, showing its discharging nozzle side surface.
Figure 1B:
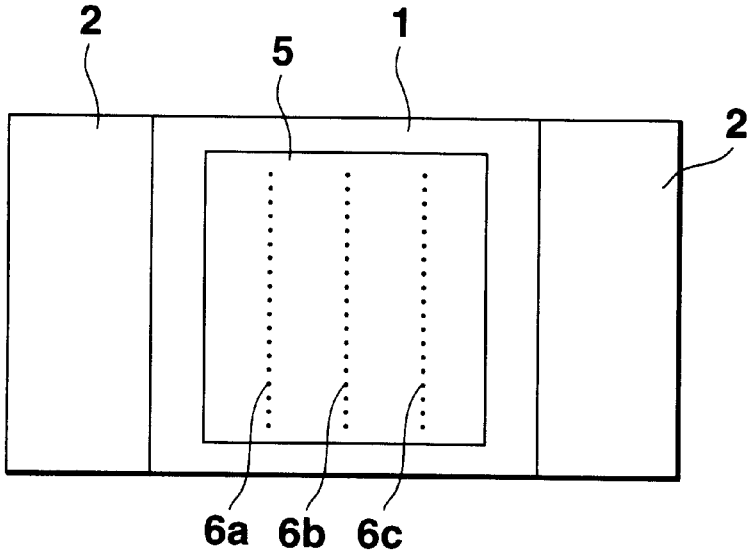
FIG.1B (PRIOR ART)
Figure 2:
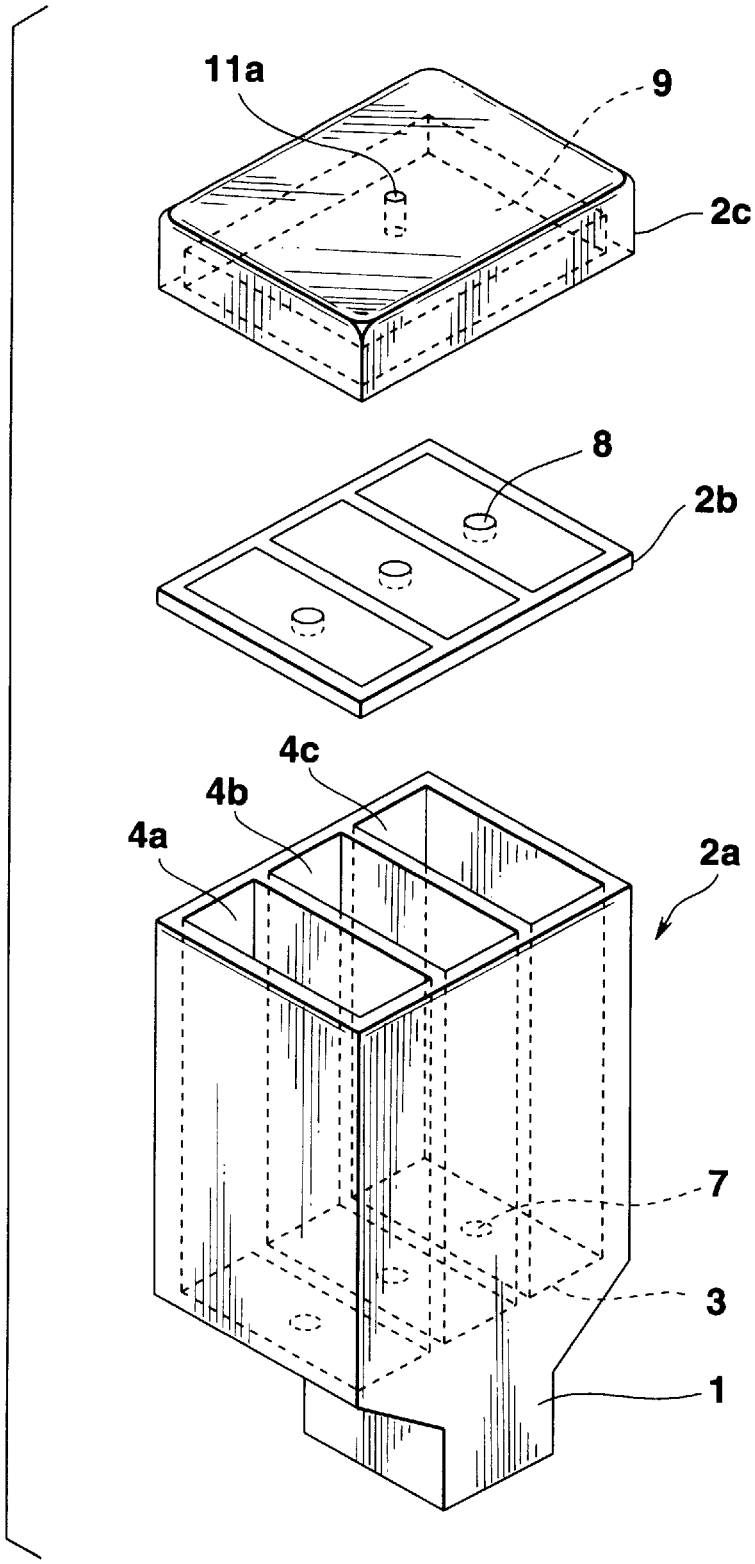
FIG.2 (PRIOR ART)
FIG. 2 is a decomposed perspective view of the conventional ink cartridge of FIG. 1A.

The inside of the ink tank 21 is partitioned into an inner chamber 24 and two adjacent outer chambers 25 and 26 formed so as to surround the inner chamber 24. The inner and outer ink chambers 24–26 correspond to the respective three lines of nozzles of the print head 23 (FIG. 1B). Ink absorbents (not shown) are disposed within the respective chambers so as to hold inks therein in a state where appropriate negative pressures are applied to the inks present in the discharge nozzles to such an extent that the inks are prevented from flowing out uselessly to the outside due to gravity.

Ink feeding holes 27 are respectively formed in the bottoms of the ink chambers 24–26 to feed the inks through the ink feeding section 22 to the print head 23. The inks held in the ink absorbents within the ink chambers 24–26 are fed from the ink feeding holes 27 through the respective ink paths (not shown) to the corresponding lines of nozzles of the print head 23.

An inner lid 28 of FIG. 3 is thermally fused or bonded to the top of the ink chambers 24–26. The inner lid 28 is provided with conductive holes 29 at appropriate positions thereof corresponding to the ink chambers 24–26 such that three color (magenta, cyan and yellow) inks are injected through the conductive holes 29 to the respective ink chambers 24–26 to be filled into the ink absorbents within the ink chambers.

Thereafter, a box-like outer lid 31 is thermally fused or bonded to the top of the inner lid 28. The outer lid 31 has a small air vent 33 on its upper surface to form an inner air chamber 32 under the upper surface. The air chamber 32 and the air conductive hole 33 are provided such that the inks filled in the ink chambers 24–26 are always fed smoothly to the print head 23, which is an important composition for the ink cartridge.

As described above, the ink cartridge unit 20 is comprises of the ink tank 21, inner and outer lids 28 and 31, and print head 28 formed integrally. Thus, the ink cartridge unit 20 has the three outer chambers (outer chambers 25, 26 and air chamber 32) formed between the outer wall (housing) of the cartridge unit 20 and five outer surfaces of the inner chamber 24 in the form of a cuboid except for its surface on the ink feeding section 22 side.

Now, assume that the cartridge unit 20 is recharged with an ink from outside. Since this unit has a lower portion which includes the print head 23 and the ink feeding section 22, a recharging hole cannot be formed from below. However, such ink recharging holes can be easily formed in the side walls of the outer chambers 25 and 26. The chambers 25 and 26 can then be recharged with inks through the ink recharging holes, and the holes can be easily sealed with an adhesive tape or the like.

However, an ink recharging through hole of the inner chamber 24 must be formed through the outer chamber 25 or 26 in the wall of the inner chamber 24. According to this method, the inner chamber 24 can be recharged with an ink. Although the hole formed in an outer side wall of the ink tank 21 can be sealed with an adhesive tape or the like, the hole formed in the side wall of the inner chamber 24 cannot be sealed. In other words, the ink recharged into the inner chamber 24 would leak through the hole formed in the wall of the inner chamber 24 to the adjacent outer chamber 25 or 26 to mix with an ink having a different color stored within the outer chamber to thereby change the color or quality of the ink which has remained in the outer chamber. Unless the inner chamber 24 can be recharged from the outside, no color printing can be performed even if the outer chamber 25 or 26 can be recharged with a proper ink. Thus, the user cannot recharge the ink into, and then reuse, the ink cartridge unit 20.

Since the air chamber 32 is provided above the unit 20, it is difficult to identify the position of the inner chamber 24 from outside. Even if the user can form holes forcibly at the proper positions in the unit, one of the holes, for example, formed in the inner lid 28 which forms a partition between the inner chamber 24 and the air chamber 32 cannot be sealed similarly. Thus, an ink would easily leak out when the unit is carried. If the inner lid 28 is made of a rigid material such as steel, it is difficult to form an ink recharging hole in the top of the inner chamber 24 to thereby prevent ink recharging with increased reliability.

Figure 4A:
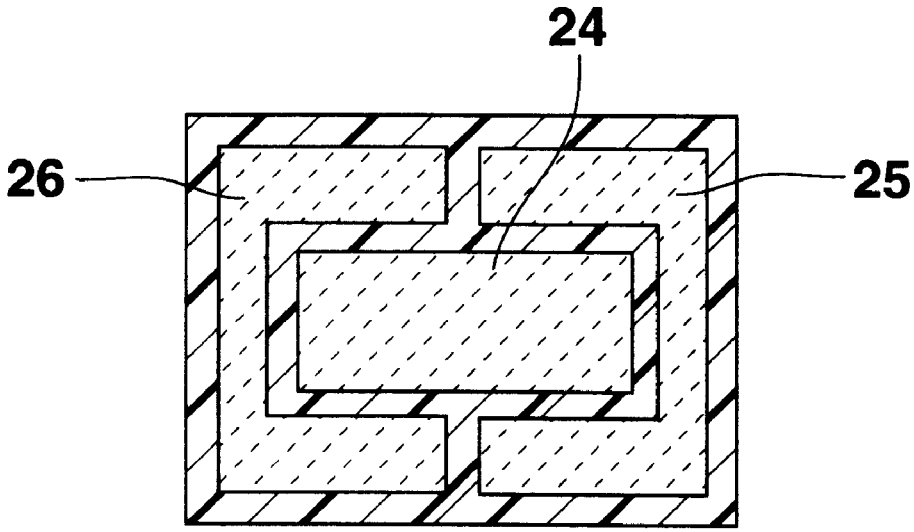
FIG. 4A is a plan cross-sectional view of an ink tank of the first embodiment.

FIG. 4A is a plan cross-sectional view of the ink chambers of the unit 20. In FIG. 4A, the broken-line hatched areas denote the inner and outer ink chambers 24, 25 and 26 in which the inks and their absorbents are disposed. In the particular embodiment, only one inner chamber is provided.

Figure 4B:
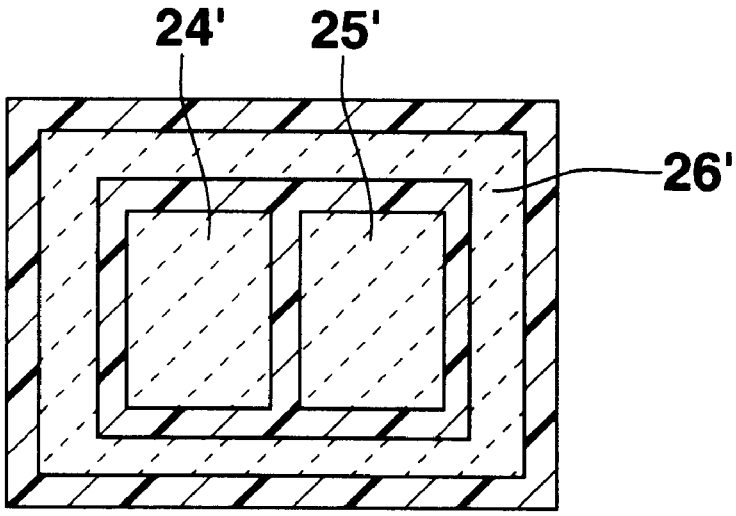
FIG. 4B is a plan cross-section view of an ink tank of a modification of the first embodiment.

In a modification of the first embodiment shown in FIG. 4B, two inner chambers 24' and 25' and a single outer chamber 26' which surrounds the inner chambers may be provided. In this case, the two inner chambers 24' and 25' cannot be recharged with two kinds of inks, and reuse of the unit recharged with inks can be prevented with increased reliability.

FIG. 5 shows a decomposed perspective view of an integrated print head-ink cartridge unit as another modification of the first embodiment. FIG. 6 is a plan cross-sectional view of an ink tank of the unit. As shown in FIG. 5, the unit includes an ink tank 35 and a print head 37 integral with the print head 37 and formed through an ink feeding section 36 below the ink tank 35. The composition of the print head 37 is similar to that of the print head 23 of FIG. 3.

The inside of the ink tank 35 is partitioned into three inner chambers 41, 42, 43 and an outer adjacent chamber 44 which surrounds those inner chambers. The inner chambers 41–43 correspond to the three lines of nozzles (not shown) of the print head 37 with ink absorbents which hold the inks being disposed within the ink chambers 41–43 as in the first embodiment. The outer chamber 44 is formed merely as an empty space.

Each of the ink chambers 41–43 has an ink feeding hole 38 in its bottom so as to feed an ink to the print head 37 through the ink feeding section 36. The ink held within the ink absorbent is fed through the ink path (not shown) to the corresponding line of nozzles of the print head 37. An inner lid 39 of FIG. 5 is thermally fused or bonded to the top of the ink chambers 41–43 and the space chamber 44. Conductive holes 45 are formed at appropriate positions in the inner lid 39 corresponding to the ink chambers 41–43 such that three kinds of magenta, cyan and yellow inks are injected through the conductive holes 45 into the corresponding ink chambers 41–43 to be sufficiently absorbed and filled within the inks absorbents within the ink chambers and then the ink charging is terminated.

Thereafter, an outer lid 31 is thermally fused or bonded to the top of the inner lid 39 for the reason mentioned above.

Also, in this case, the unit 30 is composed integrally of the print head 37, ink tank 35, inner lid 39 and outer lid 31. Thus, the unit 30 includes the three inner chambers 42–43, and the outer chambers 44 and 32 (the latter is the air chamber) surrounding the inner chambers 41–43 between the inner chambers and the outer wall of the unit 30, excluding the ink feeding section 36.

With this unit 30, even if three holes are formed through the side walls of the inner ink chambers 41–43 and the outer wall of the outer chamber 44 to recharge the three inner ink chambers 41–43 with inks, those holes formed in the walls of the three inner chambers 41–43 cannot be sealed as in the above embodiment. Thus, in the present embodiment, the inks recharged into the inner chambers 41–43 would not leak out and mix with the inks in the other respective inner chambers, but cannot be prevented from leaking out into the outer chamber 44. This securely prevents recharging the unit 30 with inks from outside.

FIG. 7 is a decomposed perspective view of an integrated print head-ink cartridge unit 50 as a second embodiment of the present invention. FIG. 8 is a plan cross-sectional view of an ink tank 51 of the unit 50.

The cartridge unit 50 has a print head 52 integral with, and below, an ink tank 51 through an ink feeding section (not shown). The inside of the ink tank 51 is partitioned into three ink chambers 53, above which as shown in FIG. 7, an inner lid 55 with air conductive holes 54 provided at positions corresponding to the respective ink chambers 53, is thermally fused or bonded to the ink chambers 53. In addition, as shown in FIG. 7, a box-like outer lid 58 with an air conductive hole 56 and an air chamber 57 to be formed is thermally fused or bonded to the top of the inner lid.

Ink feeding holes (not shown) are provided in the respective bottoms of the ink chambers 53 to feed inks therethrough to the print head 52 as in the first embodiment. Ink absorbents (not shown) which produce appropriate negative pressures to hold inks for the discharging nozzles are disposed within the respective ink chambers 53.

As shown in FIGS. 7 and 8, in the cartridge unit 50 of the second embodiment, at least four of the outer walls of the ink tank 51 are all covered with a corrugation of extending parallel ridges 59 arranged at intervals P of not more than 10 mm with a height D of not less than 0.1 mm. When a hole is formed in the outer wall of the ink tank, the corrugation acts as an anti-sealing means which prevents the formed hole from being sealed.

Assume now that the unit 50 is recharged with an ink from outside. Since the print head 52 is provided in the lower potion of the unit 50, an ink recharging hole cannot be formed in the lower potion from below, but such a hole can be provided in the side wall of the unit. Even if the hole formed in the wall of the unit is tried to be sealed, for example, with an adhesive tape after ink recharging, the corrugation ridges 59 would be an obstacle to adhesion of the adhesive tape to the whole periphery of the hole and hence the formed hole cannot be completely sealed.

Thus, when an ink is recharged into the unit up to a level above the position of the hole, the ink would leak out from the hole. Even if the level of the recharged ink is below the position of the hole, the ink can leak out undesirably when the unit is moved for scanning purposes or conveying purposes. Even if the user recharges the cartridge unit with an ink, the cartridge unit cannot be used normally. As a result, recharging the cartridge with the ink is prevented.

FIG. 9 is a decomposed perspective view of an integrated print head-ink cartridge unit 60 as a modification of the second embodiment of the present invention. FIG. 10 is a plan cross-sectional view of an ink tank of the unit 60. The cartridge unit 60 has a print head 62 integral with an ink tank 61. The inside of the ink tank 61 is partitioned into three ink chambers 63, above which as shown in FIG. 9, an inner lid 65 with air conductive holes 64 provided at positions corresponding to the respective ink chambers 63, is thermally fused or bonded to the ink chambers 53. In addition, as shown in FIG. 9, a box-like outer lid 68 with an air conductive hole 66 and an air chamber 67 to be formed is thermally fused or bonded to the top of the inner lid. Ink feeding holes (not shown) are provided in the respective bottoms of the ink chambers 63 to feed inks therethrough to the print head 62. Ink absorbents (not shown) are disposed within the respective ink chambers 63. Such composition is similar to that of the cartridge unit 50 of the second embodiment.

In the case of the unit 60 of this embodiment, as shown in FIGS. 9 and 10, at least four of the outer walls are each covered with a corrugation of two kinds of (higher and lower) ridges 69*a* and 69*b* arranged at intervals P of not less than 10 mm with a height D of not less than 0.1 mm. That is, the fact that the interval between any two adjacent ridges 69*a* and 69*b* is small and their heights are different makes it difficult to drill an appropriate hole in the outer walls of the cartridge unit 60 and makes it more difficult to completely seal the hole in the outer wall with an adhesive tape or like.

While the second embodiment and its modification have many parallel ridges and grooves as the anti-sealing means, the present invention is not limited to those particular cases. For example, an array of dot-like convexities may be used, which will be described next as a third embodiment.

FIG. 11 is a decomposed perspective view of an integrated print head-ink cartridge unit 70 as a modification of the third embodiment. The cartridge unit 7 includes a print head 67 integral with an ink tank 71. The inside of the ink tank 71 is partitioned into three ink chambers 73, above which as shown in FIG. 11, an inner lid 75, with air conductive holes 74 provided at positions corresponding to the respective ink chambers 73 as shown in FIG. 7, is thermally fused or bonded to the ink chambers 73. In addition, as shown in FIG. 11, a box-like outer lid 78 with an air conductive hole 76 and an air chamber 77 to be formed is thermally fused or bonded to the top of the inner lid. Ink feeding holes (not shown) are provided in the respective bottoms of the ink chambers 73 to feed inks therethrough to the print head 72. Ink absorbents (not shown) are disposed within the respective ink chambers 73. Such composition is similar to that of the cartridge unit 50 of the second embodiment.

In the case of the unit 70 of this third embodiment, as shown in FIG. 11, at least four of their outer walls are covered with an array of dot-like convexities 79 arranged at intervals P of not less than 10 mm with a height D of not less than 0.1 mm. Even by providing such array of dot-like convexities 79 as the anti-sealing means on the outer surfaces of the unit as in the present embodiment, those dot-like convexities 79 serve to hinder sealing the formed recharging hole with an adhesive tape. That is, the hole cannot be completely sealed with an adhesive tape or the like.

FIGS. 12A to 12G each illustrate a different modification of the convexities as the anti-sealing means of the present invention provided on the outer surface of the unit.

Figure 12A:
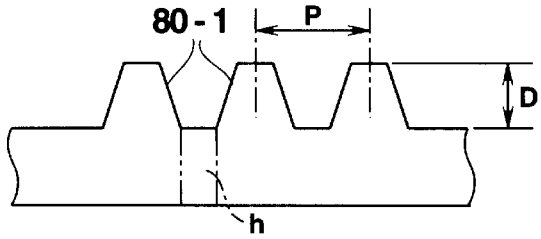

Convexities 80-1 of FIG. 12A each take the form of a tooth of a gear in cross section. The pitch (or interval) P of adjacent teeth 80-1 is about 7.5 mm, and their height (or the depth of a valley) D is about 3 mm. Assume now that a hole is formed in the bottom of a valley surrounded by the convexities 80-1 on the unit's outer surface with a general drill edge having a diameter of about 2 mm, for recharging the ink cartridge with an ink, so as to cover substantially the whole area of the valley bottom without leaving a flat peripheral area around the hole, as shown by a dot-dot-dashed line. In this case, it is very difficult to completely seal the formed hole with a sealing tape or the like.

The respective convexities 80-2 to 80-6 of FIGS. 12B to 12F each take the form of a square in cross section in which the convexities having vertical walls make adhesion of the adhesive tape to the valley bottom more difficult and are more preferable as the anti-sealing means.

Figure 12B:
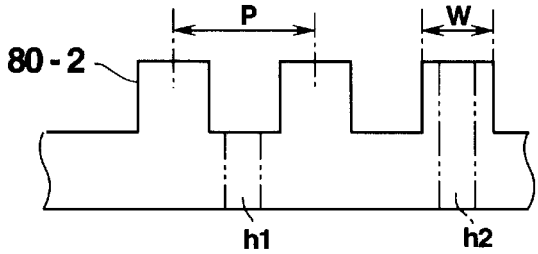

FIG. 12B shows convexities 80-2 formed at intervals or pitches P of about 10 mm on the outer wall of the unit with holes h1 and h2 each having a diameter of 2 mm formed by a drill edge having a corresponding diameter in the outer wall between any adjacent convexities 80-2. The hole h1 formed in the outer wall between the adjacent convexities is difficult to seal because the convexities 80-2 act as obstacles whereas the hole h2 formed in the convexity 80-2 itself is relatively easy to seal. Thus, preferably, the width W of the top of the convexity 80-2 is not more than 2 mm which is the drill's diameter. This example is represented by convexities 80-3 of FIG. 12C.

Figure 12C:
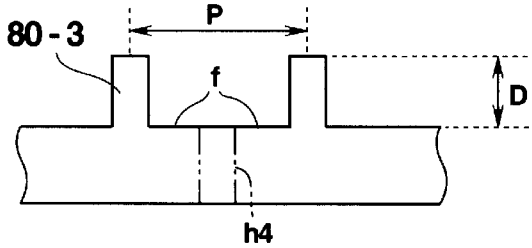

In FIG. 12C, the interval P between the convexities 80-3 is 10 mm as in the above case whereas the width of its top is substantially the same as the diameter of a hole h4 to be formed or the diameter of the drill which is 2 mm. With those convexities 80-3, holes 4 cannot be drilled in their tops. However, with this example, relatively thin convexities 80-3 are provided at relatively large intervals P of 10 mm, and hence a flat peripheral area f could be formed around a hole h4 drilled in the outer unit surface between the convexities. As a result, the hole h4 is relatively easy to seal, and hence the wall structure is not a preferable one. Thus, when the width of the tops of the convexities is 2 mm, the interval P between the convexities is preferably not more than about 6 mm. The height D of the convexities is preferably increased to a maximum.

Figure 12D:
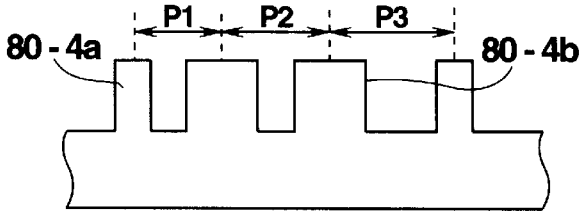

FIG. 12D shows an example in which narrower and wider convexities 60-4*a* and 60-4*b* are arranged at different distances P1, P2 and P3 in a mixing manner so as to make it difficult to securely seal possible holes formed anywhere in the outer unit surface.

Usually, in order to seal with an adhesive seal a hole having a diameter of 2 mm securely, the seal having a flat sticking tab of at least 4 mm is required. Thus, an adhesive seal having a diameter of not less than 10 mm is required to be stuck flat on the outer unit surface so as to cover the hole. If the convexities have different widths and are arranged at different intervals, as shown in FIG. 12D, a sticking tab used securely changes from place to place. Thus, it is very difficult to completely seal at all times a possible hole formed anywhere in the outer unit surface.

Figure 12E:
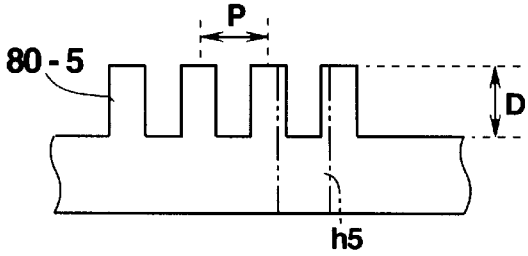

Convexities 60-5 of FIG. 12E are provided on the outer wall of the unit at intervals P of 3 mm with a height D of 3 mm. In this case, wherever a hole h5 of a diameter of 2 mm is formed, a flat sticking tab of not less than 4 mm cannot be obtained around the hole. Thus, it is very difficult to seal the hole h5 completely.

Figure 12F:
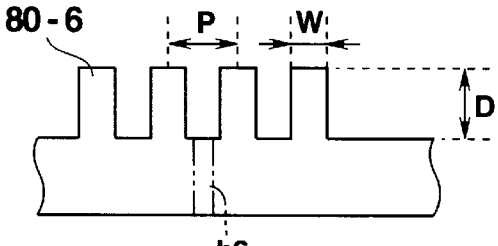

The convexities 80-6 of FIG. 12F are arranged at intervals of 5 mm with their top width W being 2.5 mm and their height D being 3 mm. In this case, a hole h6 is difficult to form and to seal, and they are very effective as the anti-sealing means.

Figure 12G:
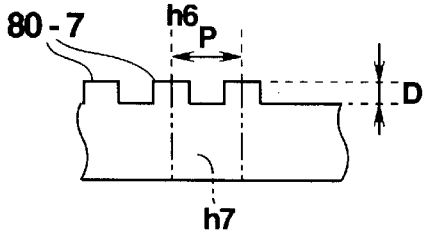

Convexities 80-7 of FIG. 12G is a modification of the convexities 80-6 where the convexities 80-7 have a height lower than the convexities 80-6 with their top width w being 2.5 mm and their height D being 1 mm and are arranged at intervals P of 2 mm. In this case, compared to the modifications of FIGS. 12E and 12F, a hole h7 having a diameter of 2 mm is easier to form, but it is almost impossible to seal the hole h7 with an adhesive sheet because the intervals P between the convexities 80-7 is small or 2 mm.

It will be obvious from the result of studying the modifications of the various convexities, mentioned above, that the outer wall of the cartridge unit of the present invention have thereon convexities arranged at intervals of not more than 10 mm with a height of not less than 0.1 mm. Preferably, they are arranged at intervals of not more than 5 mm and have a height of not less than 1 mm. More preferably, they are arranged at intervals of not more than 2 mm and have a height of not less than 5 mm. The reason why the convexities preferably have a height of not less than 0.1 mm in the invention is that a hole provided in the bottom area between the convexities cannot be sealed securely by filling the valley bottom and sealing the hole in the valley bottom only with an adhesive layer of a thick adhesive sheet having a thickness of about 100 $\mu$m used only for sealing the hole compared to a general adhesive sheet having an adhesive layer of 15–50 $\mu$m.

FIG. 13A is a plan cross-sectional view of an ink tank covered with another modification of convexities as the anti-sealing means. FIG. 13B illustrates a further modification of the convexities.

Ridges 81 of FIG. 13A are slanted so as to cover respective adjacent ridges 82. In this case, even if a hole can be formed so as to extend in a slanting manner along the slanting ridges 81, the slanting ridges 81 will be obstacles to sealing the hole. Thus, it is very difficult to completely seal the hole.

FIG. 13B shows slantingly intersecting parallel ridges 83. Also, in this case, it is required that the interval between adjacent parallel ridges 83 is not more than 10 mm and that the height of the convexities 83 is not less than 0.1 mm. Conversely, the ridges 83 may be formed within corresponding grooves. In this case, the unit has an outer surface structure which is obtained by replacing the circular dot-convexities 79 in the embodiment of FIG. 11 with diamond-shaped pillars.

The shapes of the convexities as the anti-sealing means in the present invention are not limited to the various embodiments described above, but may take other various shapes such as a hemisphere, cone or cross.

The inventive anti-sealing means are not limited to the outer chambers and air chambers of the first embodiment, and the ridges and dot-like convexities of the second and third embodiments. Various other arrangements may be applicable, of course.

For example, concavities may be formed in the outer wall of the cartridge unit at the same intervals as the convexities of the above embodiments. Alternatively, an anti-sealing layer of a porous material such as sponge, or urethane foam may be formed on the outer walls of the unit.

A fourth embodiment of the present invention of FIG. 14 includes a combination of an ink tank of the first embodiment of FIG. 3 and dot-like convexities of the third embodiment of FIG. 11.

The integrated print head-ink cartridge unit of this embodiment has an ink tank 85 with its outer wall being covered with an array of dot-like convexities 86 having a height of not less than 0.1 mm and arranged at intervals of not more than 10 mm. As in the first embodiment, the inside of the ink tank 85 is partitioned into an inner chamber 85*a* and outer chamber 85*b* and 85*c* surrounding the inner chamber, which chambers are filled with inks of different colors.

A flat lid 87 is placed on the top of the ink tank 85 with a print head 23 being fixed to the lower end of the ink tank 85. The lid 87 has three air vents 88*a*, 88*b* and 88*c* which fluid communicate with the inner and outer chambers 85*a*, 85*b* and 85*c*, respectively. An outer surface of the lid 87 is covered with the same array of dot-like convexities 86 as are formed on the side walls of the ink tank 85, and having a height of not less than 0.1 mm and arranged at intervals of not more than 10 mm.

As described above, the cartridge unit of this embodiment has almost all outer surfaces covered with arrays of dot-like convexities as the anti-sealing means, excluding the ink feeding section. Even if the user tries to form an appropriate ink recharging hole in the side wall of the ink tank 85 or the lid 87, by setting a drill edge normal to the outer wall of the tank, it is difficult to obtain such hole because the dot-like convexities 86 are formed, and even if a hole should be formed, it cannot be completely sealed. Thus, it is difficult to recharge the inner chamber 85*a* as well as the outer chambers 85*b* and 85*c* with inks. That is, since it is difficult to recharge all the ink chambers 85*a*–85*c* with inks in the cartridge unit of the present embodiment, recharging the tank with inks is prevented materially with higher reliability compared to the first embodiment which is capable of preventing only recharging the inner chamber 24 with an ink.

FIG. 15 is a decomposed perspective view of an integrated print head-ink cartridge unit of a fifth embodiment of the present invention.

As shown in FIG. 15, in the integrated print head-ink cartridge unit of this embodiment, a print head 93 is formed below, and integrally with, an ink tank 91 through an ink feeding section 92. The ink tank 91 is partitioned into three ink chambers 91*a*, 91*b* and 91*c* of substantially the same size. Those ink chambers 91*a*–91*c* are arranged in a direction perpendicular to, or across, the longitudinal lines of nozzles.

The ink chambers 91*a*–91*c* have ink feeding holes (not shown) in their bottoms 91*d*, which will be described in more detail later. The inks within the respective inks chambers 91*a*–91*c* are fed from the ink feeding holes through ink paths, which will be also described in more detail later, to the lines of nozzles on the print head 93. Ink absorbents (not shown) are disposed within the ink chambers 91*a*–91*c* of the ink tank 91.

An inner lid 94 of FIG. 15 is thermally fused or bonded to the top of the ink chambers 91. The inner lid 94 has three air conductive holes 95 at positions corresponding to the respective ink chambers 91*a*–91*c*. In a factory, inks are injected through the air conductive holes 95 into the ink chambers 91*a*, 91*b* and 91*c* to a predetermined range which contains at least the range where the ink absorbents are disposed.

Thereafter, a box-like outer lid 96 is thermally fused or bonded to the top of the inner lid 94. The outer lid 96 has a small air vent 98 at its center such that its inner space is formed as an air chamber 97. The air fluid communicates with the respective ink chambers 91*a*–91*c* from the vent 98 through the air chamber 97 and the three air conductive holes 95. This ensures that the respective ink chambers 91*a*–91*c* are placed in free fluid-communication state and that the inks absorbed and filled by the ink absorbents disposed within the ink chambers will be smoothly fed to the print head 93.

FIG. 16A is a plan view of the cartridge unit (viewed in a direction of arrow B of FIG. 15), and FIG. 16B a cross-sectional view taken along a line C–C' of FIG. 16B. The print head 93 includes on a silicon chip substrate 99 drive circuits (diffusion sections) 101 formed by an LSI processing technique, and heating elements 102, individual wiring electrodes 103 and a common electrode 104 for conveying drive signals from the drive circuits 101 to the heating elements 102, formed by a thin film forming technique.

A partition 105 is layered on those elements to form ink paths corresponding to the respective heating elements 102. The silicon chip substrate 99 has ink feeding grooves 106*y*, 106*m*, 106*c* which fluid communicate with the ink paths, and ink feeding holes 107*y*, 107*m* and 107*c* which fluid communicate with the grooves 106*y*, 106*m* and 106*c* and which are open to the back of the silicon chip substrate 99. The grooves 106*y*, 106*m* and 106*c* and the holes 107*y*, 107*m* and 107*c* are, for example, formed by a sand blasting method.

Nozzle plates 108 are thermally pressed on the partitions 105 so as to form discharging nozzles 109 provided at positions opposite to the respective heating elements 102. The print head 93 includes three monochromatic color heads; that is, yellow (Y), magenta (M) and cyan (C) heads, arranged side by side on the single silicon chip substrate 99.

FIGS. 17A to 17F each schematically show a different combination of the respective ink feeding holes 107*y*, 107*m* and 107*c* in the print head 93 and the respective ink chambers 91*a*–91*c* of the ink tank 91.

FIGS. 17A to 17F each are obtained when the cartridge unit is viewed in the same direction as in FIG. 16A. The ink feeding grooves 106*y*, 106*m* and 106*c* of FIG. 16B are shown by broken lines in a perspective manner. There are six combinations of the ink feeding holes 107*y*, 107*m* and 107*c* and the three ink chambers 91*a*–91*c*.

Figure 17A:
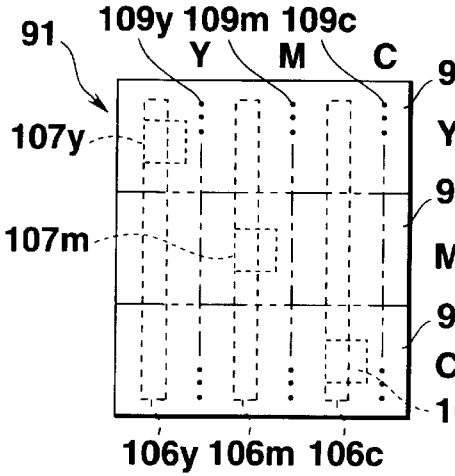

First, FIG. 17A shows the same arrangement of ink feeding holes 107*y*, 107*m* and 107*c* as FIG. 16A. In this example, the ink feeding groove 106*y* which feeds a yellow ink to the line of nozzle 109*y* which discharges a yellow ink has an ink feeding hole 107*y* provided at an end of the ink chamber 91*a* and fluid communicating with the nearest ink chamber 91a, which is therefore filled with the yellow ink. Thus, the ink chamber 91*a* is filled with a yellow ink. In this case, in order that the ink flow paths may be shortened to the maximum to reduce their resistance, the ink feeding hole 107*y* is provided at a position aligning with an ink feeding port (not shown) provided in the bottom of the yellow ink chamber 91*a*.

Similarly, the ink feeding groove 106*m* which feeds a magenta ink to the line of nozzles 109*m* which at all times discharges a magenta ink has at its midpoint the ink feeding hole 107*m* fluid communicating with the nearest ink chamber 91*m*, which is filled with the magenta ink. Also, similarly, the ink feeding groove 106*c* which feeds a cyan ink to the line of nozzles 109*c* which at all times discharges a cyan ink has the ink feeding hole 107*c* in an end of the ink chamber 91*c* so as to fluid communicate with the nearest ink chamber, i.e., 91*c*, which is filled with the cyan ink.

Figure 17B:
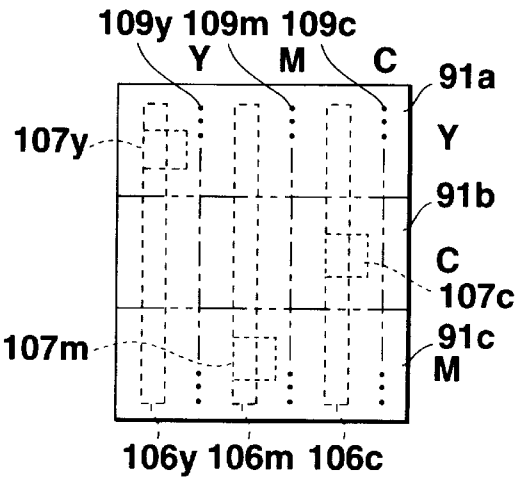

In an example of a combination of FIG. 17B, the line of nozzles 109*y* similarly fluid communicates with the ink chamber 91*a* in the same manner as is described above. Thus, the position of the ink feeding port 107*y* is unchanged and the ink chamber 91*a* is filled with an yellow ink. However, the lines of nozzles 109*m* and 109*c* communicate with the ink chambers 91*c* and 91*b*, respectively, which is converse to the case of FIG. 17A. Therefore, the ink chambers 91*b* and 91*c* are filled with cyan and magenta inks, respectively.

Figure 17C:
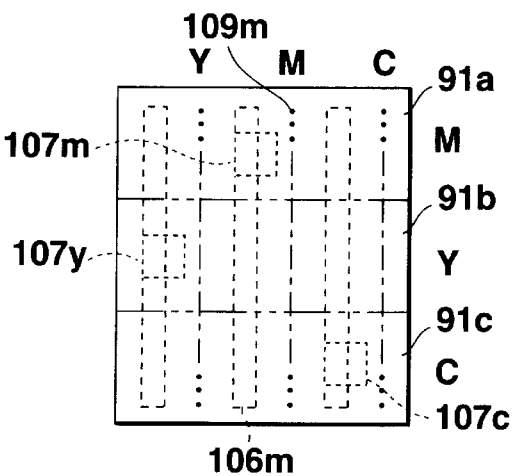
Figure 17D:
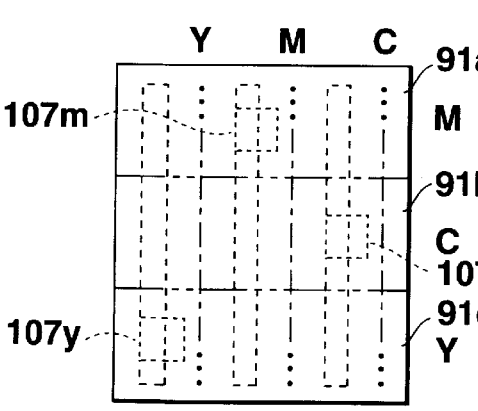

FIGS. 17C and 17D illustrate further combinations. Both those combinations are the same in that an ink feeding port 107*m* which feeds a magenta ink to a line of nozzles 109*m* is provided at an end of an ink chamber 91*a* for an ink feeding groove 106*m*, and that an ink chamber 91*a* is filled with the magenta ink, but are different in that the ink chambers 91*b* and 91*c* which are filled with the yellow and cyan inks, respectively, are replaced in position with each other.

Figure 17E:
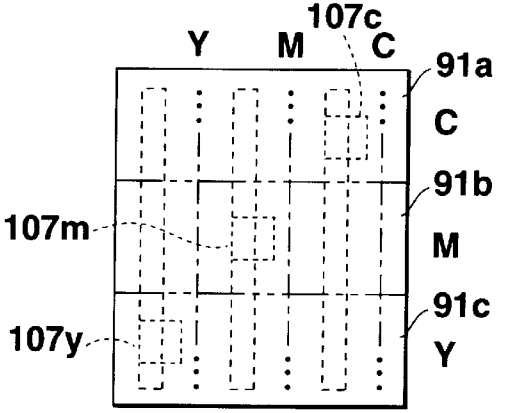
Figure 17F:
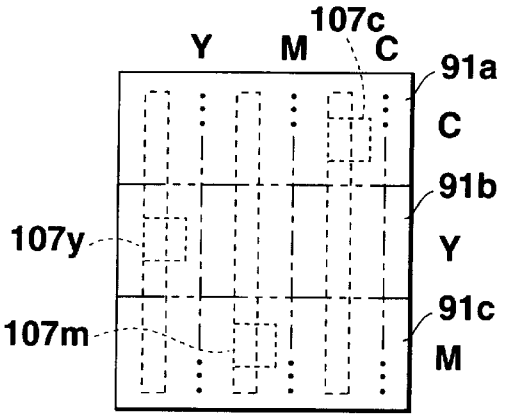

FIGS. 17E and 17F illustrate still further combinations. Both the combinations are the same in that an ink feeding port 107*c* which feeds a cyan ink to a line of nozzles 109*c* is provided at an end of an ink chamber 91*a* for the ink feeding groove 106*c*, and that an ink chamber 91*a* is filled with the cyan ink, but are different in that the ink chambers 91*b* and 91*c* are filled with the yellow and magenta inks, respectively, in FIG. 17E whereas the ink chambers 91*b* and 91*c* are filled with the magenta and yellow inks, respectively, in FIG. 17F.

A plurality of sorts of integrated print head-ink cartridge units including different combinations of the lines of nozzles and ink chambers which fluid communicate through the plurality of ink feeding holes 107*y*, 107*m* and 107*c* provided in correspondence to the plurality of ink chambers are manufactured in units of an appropriately round quantity. In this case, the plurality of sorts of ink tanks are manufactured by a single mold which has a plurality of different cavities corresponding to those of the plurality of sorts of ink tanks or by a plurality of different sorts of molds which each have a plurality of arranged identical cavities each corresponding to one ink cartridge. In the case of this embodiment, the different sorts of ink tanks respectively have the same partition structure, but different arrangement of the ink feeding ports provided in the bottoms of the ink chambers.

Since the colors of inks discharged from the lines of nozzles are predetermined, the ink chambers are charged with the inks having the respective predetermined colors such that those inks are discharged from the predetermined lines of nozzles, respectively.

As described above, the integrated print head-ink cartridge unit of FIGS. 17A to 17F fix the colors of inks discharged from the respective lines of nozzles 109*y*, 109*m* and 109*c* of the print head 93. In addition, those units are constituted such that the user cannot easily recognize from the appearance of the unit in which chambers of the unit what colors of inks are contained. When the units are shipped from the factory, any one kind of ink cartridge units are selected randomly from among the manufactured plurality of kinds of ink cartridge units and shipped as the parts of the ink jet printer.

By manufacturing and shipping the ink cartridge units as described above, the user of the ink jet printer cannot recognize the kind of ink cartridge unit which he or she uses. Thus, even when the user tries to recharge an emptied cartridge unit with an ink, he or she cannot from the appearance of the unit where in the unit which colors of ink are contained. Thus, it is very difficult for the user to recharge the unit with an ink. As a result, recharging the unit with an ink by the user is effectively prevented.

Two modifications of the fifth embodiment will be next described with reference to FIGS. 18A and 18B which shows different partitions of the ink chamber of the cartridge unit 90. FIGS. 19A, 19B and 19C show three further modifications of different partitions of the ink chamber.

In an integrated print head-ink cartridge unit 110 of FIGS. 18A and 18B, the colors of inks discharged from the lines of nozzles 109*y*, 109*m* and 109*c* are yellow, magenta and cyan inks, which is the same as the case of the fifth embodiment. However, the FIGS. 18A and 18B structures which partition the ink chambers 111*a*, 111*b* and 111*c* are different from those of the fifth embodiment of FIGS. 17A to 17F in that the two ink chambers 111*a* and 111*b* are formed by bisecting two thirds of the volume of the ink tank of the unit 110 and that the third ink chamber 111*c* is formed by the remaining one third of the volume of the ink tank.

In the examples of combinations of FIG. 18A and B of the embodiments, both the ink chambers 111*b* fluid communicate with the corresponding lines of nozzles 109*c*. The lines of nozzles 109*y* and 109*m* fluid communicate with the ink chambers 111*a* and 111*c*, respectively, in FIG. 18A whereas, conversely, the lines of nozzles 109*y* and 109*m* fluid communicate with the ink chambers 111*c* and 111*a*, respectively, in FIG. 18B.

Integrated print head-ink cartridge units 112 of FIGS. 19A, 19B and 19C each include three ink chambers 113*a*, 113*b* and 113*c* of the same volume to which a rectangular parallelepiped ink tank is divided with two parallel slanting partitions. In the present embodiment, the ink chamber 113 extending from one corner to a diagonal corner of the ink tank faces three ink feeding grooves 106*y*, 106*m* and 106*c* so as to easily fluid communicate with any one of the ink feeding grooves as requested. The remaining two ink chambers 113*a* and 113*c* oppose to each other and each have two ink feeding grooves to fluid communicate easily with. Thus, in the present embodiment, the number of preferable combinations of partitioned ink chambers and lines of discharging nozzles is three, as shown in FIGS. 19A, 19B and 19C.

The partitioning structures of the ink chamber are not limited to the above embodiments and their modifications, but other various partitioning structures may be used, of course.

By changing both the combinations of ink chambers of the ink tank and lines of discharging nozzles, and the partitioning structures of the ink chambers, more kinds of cartridge units can be prepared. For example, only by employing the examples of FIGS. 17A to 17F, 18A, 18B and 19A to 19C together, fifteen types of cartridge units having the same appearance but different inner structures are obtained. As described above, the kinds of cartridge units are changed in the manufacturing lot, and one kind of ink cartridge units are selected randomly from among the plurality of kinds of ink cartridge units, and shipped. Thus, when the user takes one of the units in his or her hand, he or she cannot know which of the fifteen inner structures the selected unit has because their appearances are the same. In other words, ink recharging is almost impossible.

As described above, according to the inventive ink cartridge making method, ink cartridge units are easy to manufacture at inexpensive cost without providing any special anti-sealing means which makes difficult sealing the holes formed in the outer walls of the cartridge units as in the first-fourth embodiments, and recharging the cartridge with inks is effectively prevented.

While the fifth embodiment and their modifications are all the integrated print head-ink cartridge units, the present invention is not limited to those particular cases. The method of making integrated print head-ink cartridge units which have the same appearance but which are different in kind is applicable to making ink cartridges separate from print heads.

FIGS. 20A and 20B are a plan view of an ink cartridge separate from a print head, and a cross-sectional view taken along a line b–b' of FIG. 20A. In this case, assume that all the print heads have ink feeding holes 107*y*, 107*m* and 107*c* disposed as shown in FIG. 16A. An intermediate ink conductive plate 122 as a fluid interface member is beforehand bonded to an end of an ink tank 121 of an ink cartridge 120 joined removably to the print head. The intermediate ink conductive plate 122 has three ink conductive through holes 123*y*, 123*m* and 123*c* which fluid communicate or align with the corresponding three ink feeding holes in the print head. The intermediate ink-conductive plate 122 further has, on its ink tank 121 side surface, ink conductive grooves, which are provided as requested, for example, shown by 126*y* and 126*m*, each of which fluid communicates between a respective one of the ink conductive holes 123*y* and 123*m* and a corresponding one of the ink feeding ports 125*b* and 125*a* of the ink chambers 124*b* and 124*a* of the ink tank 121. About one half of the thickness of the intermediate ink conductive plate 122 will suffice for the depth of the ink conductive grooves 126*y* and 126*m*. Since in the present embodiment the ink conductive hole 123*y* through which the yellow ink is fed fluid communicates with the ink chamber 124*b* via the ink feeding port 125*b* and the ink conductive groove 126*y*, the ink chamber 124*b* is filled with the yellow ink. Since the ink conductive hole 123*m* through which the magenta ink is fed fluid communicates with the ink chamber 124*a* via the ink feeding ort 125*a* and the ink conductive groove 126*m*, the ink chamber 124*a* is filled with the magenta ink. The ink conductive hole 123*c* through which the cyan ink is fed fluid communicates with the ink chamber 124*c* . In this case, since the ink feeding port 125*c* of the ink chamber 124*c* is provided so as to align with the cyan ink conductive hole 123*c*, both fluid communicate directly with each other, and no ink conductive groove is required. The ink chamber 124*c* is filled with the cyan ink.

By doing so, only one kind of print head is required. Thus, this arrangement is suitable for mass production of the print heads. The arrangement of the ink feeding ports in the surface of the ink cartridge joined to the print head, and the colors of the inks fed through the ink feeding ports are fixed. Thus, also in this case, when the user takes one of the cartridges in his or her hand, it is substantially impossible for the user to determine the arrangement of the inner ink chambers and the colors of inks contained in the chambers.

As described above, in the arrangement including the intermediate ink-conductive plate, whether or not the ink cartridge is integral with, or separate from, the print head, any one of the ink feeding ports in the ink cartridge can fluid communicate with a desired one of the ink feeding holes in the print head even if the ink chambers are not disposed so as to face the ink feeding grooves. Thus, even with the arrangement of the ink chambers of FIGS. 18A and 18B, six combinations of ink feeding ports of the ink cartridge and ink feeding holes of the print head can be realized as in the case of FIGS. 17A to 17F. Thus, as the number of arrangements of ink chambers increases, the number of combinations of ink chambers and lines of nozzles increases, and the inner composition of the units cannot be understood from outside.

What is claimed is:

1. An ink cartridge which stores ink to be fed to a print head which jets the ink depending on printing data, the ink cartridge comprising:

a housing having an ink feeding section for feeding to the print head the ink stored in the ink cartridge;

at least one inner chamber included in said housing, fluid communication with the air, and filled with an ink; and at least one outer chamber provided so as to surround said at least one inner chamber at least on all sides of said at least one inner chamber;

wherein said at least one outer chamber fluid communicates with the air and is filled with an ink whose color is different from that of the ink stored in said at least one inner chamber.

2. The ink cartridge of claim 1, wherein said at least one outer chamber comprises a plurality of subchambers.

3. The ink cartridge of claim 1, wherein said ink cartridge is integrally formed with the print head.

4. The ink cartridge of claim 1, wherein the number of inner chambers included in said housing is two.

5. The ink cartridge of claim 1, wherein the number of outer chambers is two.

* * * * *